US012709440B2

(12) United States Patent
Gillis et al.

(10) Patent No.: US 12,709,440 B2
(45) Date of Patent: Aug. 18, 2026

(54) SYSTEMS AND METHODS FOR A FLUID RESERVOIR PLUG

(71) Applicant: Ford Global Technologies, LLC, Dearborn, MI (US)

(72) Inventors: John Paul Gillis, Ferndale, MI (US); JonCarlo Mancini, Medina, OH (US); Christopher K. Palazzolo, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 57 days.

(21) Appl. No.: 18/760,669

(22) Filed: Jul. 1, 2024

(65) Prior Publication Data

US 2026/0001684 A1 Jan. 1, 2026

(51) Int. Cl.

| | |
|---|---|
| ***F01M 11/04*** | (2006.01) |
| ***B65D 39/00*** | (2006.01) |
| ***B65D 39/08*** | (2006.01) |

(52) U.S. Cl.

CPC ..... *B65D 39/08* (2013.01); *B65D 39/0017* (2013.01); *F01M 11/0408* (2013.01); *F01M 2011/0416* (2013.01); *F01M 2011/0425* (2013.01)

(58) Field of Classification Search

CPC ..... F01M 11/0408; F01M 2011/0416; F01M 2011/0425

USPC ..... 251/216, 217

See application file for complete search history.

(56) References Cited

U.S. PATENT DOCUMENTS

| | | | | |
|---|---|---|---|---|
| 2,276,091 | A * | 3/1942 | Reppert | H01M 50/308 251/216 |
| 3,915,428 | A | 10/1975 | Hay | |
| 4,986,502 | A * | 1/1991 | Ceroke | F16K 51/00 251/351 |
| 5,269,346 | A | 12/1993 | Yuda | |
| 5,299,774 | A * | 4/1994 | Arneson | F16K 24/02 251/30.02 |
| 6,318,500 | B1 | 11/2001 | Mizani | |
| 7,427,181 | B2 | 9/2008 | Denton et al. | |
| 7,510,053 | B2 * | 3/2009 | Wilkins | F01M 11/0408 184/88.1 |
| 8,701,916 | B2 | 4/2014 | Cook et al. | |

(Continued)

FOREIGN PATENT DOCUMENTS

| | | |
|---|---|---|
| DE | 102008038260 A1 | 2/2010 |
| KR | 19980022221 | 7/1998 |

OTHER PUBLICATIONS

"M12.1-0.049x 0.591in Oversized Oil Drain Plug Stainless Steel Self Tapping Oil Pan Thread Repair Kit with O-Ring and Hex Wrench," Amazon Website, Available Online at www.amazon.com/PFCKE-M12-1-1-25x-Piggyback-Stainless-Hexagonal/dp/B0BBYSBY6T?th=1, Available as Early as Jan. 31, 2024, 8 pages.

*Primary Examiner* — Kevin F Murphy

(74) *Attorney, Agent, or Firm* — McCoy Russell LLP

(57) ABSTRACT

Methods and systems are provided for a fluid reservoir plug. In one example, a single-piece plug for a fluid reservoir includes a shaft, the shaft including a threading, a conduit, and a channel. The channel extends transversely through each thread of the threading to the conduit. Furthermore, while the threading is coupled to the fluid reservoir at an opening of the fluid reservoir, fluid exits the opening by flowing along the channel before flowing through the conduit.

14 Claims, 12 Drawing Sheets

(56) References Cited

U.S. PATENT DOCUMENTS

| | | | | |
|---|---|---|---|---|
| 9,523,308 | B2 | 12/2016 | Candela et al. | |
| 11,015,495 | B2 | 5/2021 | Lee et al. | |
| 11,162,594 | B2 | 11/2021 | LoCastro et al. | |
| D975,745 | S | 1/2023 | Yang et al. | |
| 12,392,268 | B1 * | 8/2025 | Mainiero | F01M 11/0408 |
| 2013/0048115 | A1 | 2/2013 | Wise | |
| 2014/0068921 | A1 * | 3/2014 | Tseng | F16B 5/0208 29/525.02 |
| 2018/0073625 | A1 * | 3/2018 | Miyazono | B21D 53/24 |
| 2020/0284356 | A1 | 9/2020 | LoCastro et al. | |

* cited by examiner

SYSTEMS AND METHODS FOR A FLUID RESERVOIR PLUG

FIELD

The present description relates generally to systems and methods for a fluid reservoir plug.

BACKGROUND/SUMMARY

Drain plugs serve as a seal for oil pans of internal combustion engines to facilitate storing lubricating oil for the engine. Additionally, drain plugs serve as a convenient access point for facilitating oil changes. Performing an oil change includes removing and completely decoupling the drain plug from the oil pan, allowing the oil to freely flow out of the open bore of the oil pan. After draining the oil, the drain plug is recoupled to the oil pan, sealing the bore of the oil pan.

Conventional drain plugs have a bolt-like design including a head mounted to a threaded shaft for coupling to the oil pan bore and a single seal to aid in preventing oil leaks from the oil pan when the drain plug is coupled to the oil pan. In one example, Lawrence LoCastro et al. (U.S. Pat. No. 11,162,594) describe a drain petcock having body with a central channel for drainage, a side wall aperture for draining, and a closing plug that both closes the central channel and overlies the side wall aperture. The partial removal of the closing plug enables a controlled flow for initial draining. A full removal of the closing plug enables a more controlled flow through the central channel for further draining.

However, the inventors herein have recognized potential issues with such systems. First, conventional drain plugs, with only a single seal, are not robust for sealing oil pans, and are susceptible to oil seepage and leaking, especially with repeated usage of the drain plug over its lifetime. Second, the drain petcock of Lawrence LeCastro et al. has a multi-piece design, and thus is more complex and more expensive to manufacture. Furthermore, a multi-piece drain plug is inherently more vulnerable to leaks due to the presence of additional fluid leak paths between the multiple pieces of the drain plug. Third, conventional drain plugs are susceptible to wear and degradation during service. In particular, the head may become warped and misshaped, rendering removal from and recoupling of the drain plug to the oil pan, and subsequent sealing of the oil pan, more difficult.

In one example, the issues described above may be addressed by single-piece plug for a fluid reservoir, the single-piece plug including, a shaft, including a threading, a conduit, and a channel, the channel extending transversely through each thread of the threading to the conduit, wherein while the threading is coupled to the fluid reservoir at an opening of the fluid reservoir, fluid exits the opening by flowing along the channel before flowing through the conduit. As one example, the channel and the conduit provide a fluid path for the fluid exiting the opening when the opening is unsealed.

In this way the single-piece fluid reservoir plug described herein provides several advantages over conventional drain plugs. First, the single-piece fluid reservoir plug seals a fluid reservoir while reducing fluid seepage and leaks. In particular, the fluid reservoir plug, being of single-piece design and construction reduces a number of leakage paths. Furthermore, the plurality of grooves, each of the plurality of grooves for placing a seal, provide the fluid reservoir plug with increased sealing ability as compared to conventional drain plugs. Second, having a head including a plurality of rotational drives, the fluid reservoir plug is more resistant to wear and degradation after repeated usage throughout its lifetime. Third, fluid can exit the fluid reservoir along the channel and out the conduit while the fluid reservoir plug is coupled to the opening, thereby reducing fluid splashes and spills during fluid changes and draining. Fourth, the single-piece construction and design reduces manufacturing complexity. Fifth, the single-piece fluid reservoir plug can be coupled to existing fluid reservoirs and can replace conventional drain plugs without modification.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

FIGS. 2-4, and 6-13 are drawn approximately to scale.

Figure 5B:
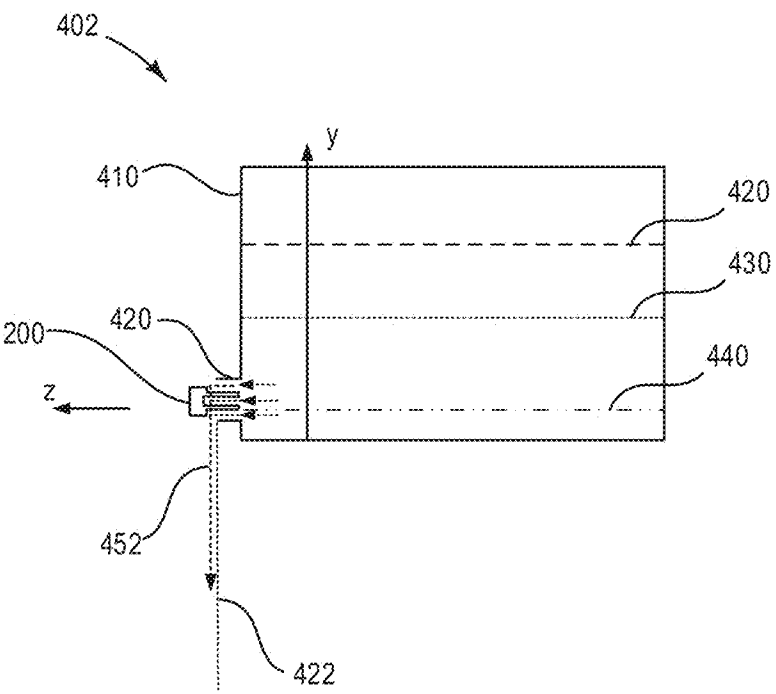
FIG. 5B shows a schematic of a fluid reservoir draining fluid while the fluid reservoir plug of FIGS. 2-4 is coupled to the fluid reservoir 610.
Figure 5A:
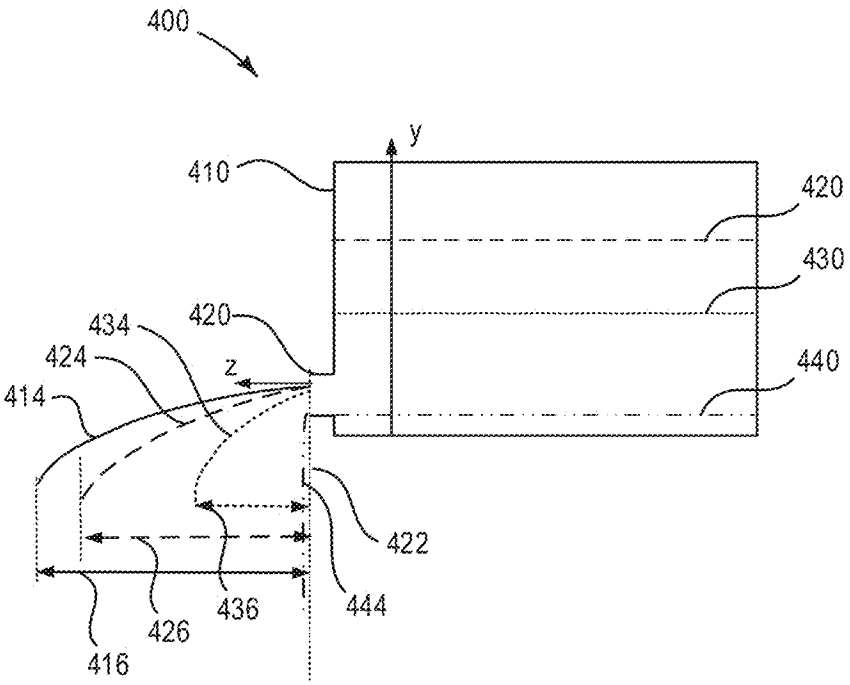
FIG. 5A shows a schematic of a fluid reservoir draining fluid freely without the fluid reservoir plug of FIGS. 2-4.
Figure 6:
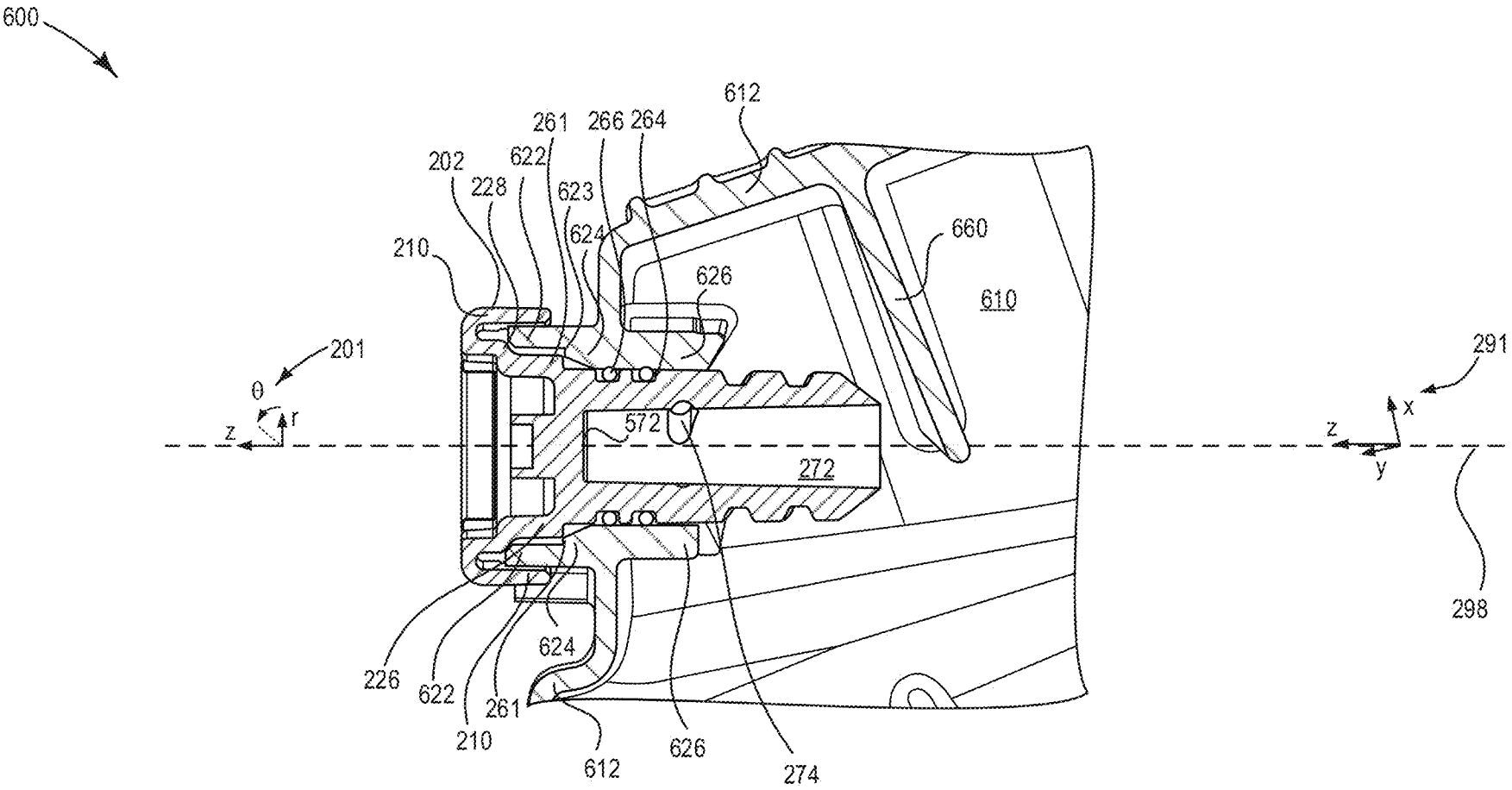
FIG. 6 shows a partial cross-sectional view of a fluid reservoir while the fluid reservoir plug of FIGS. 2-4 is coupled to the fluid reservoir and positioned in a sealed position.
Figure 7:
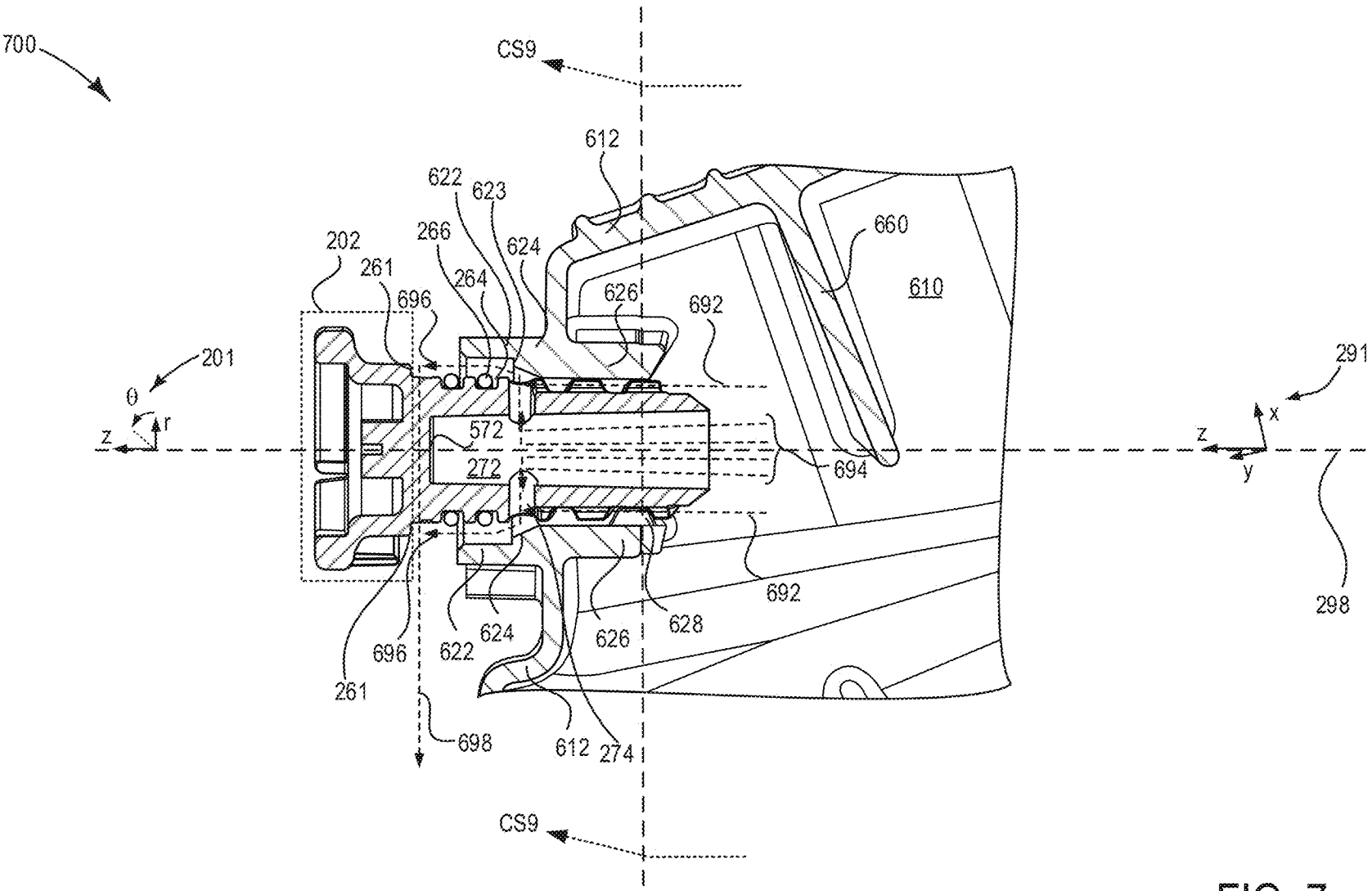
FIG. 7 shows a partial cross-sectional view of a fluid reservoir while the fluid reservoir plug of FIGS. 2-4 coupled to the fluid reservoir and positioned in an unsealed position.
Figure 8:
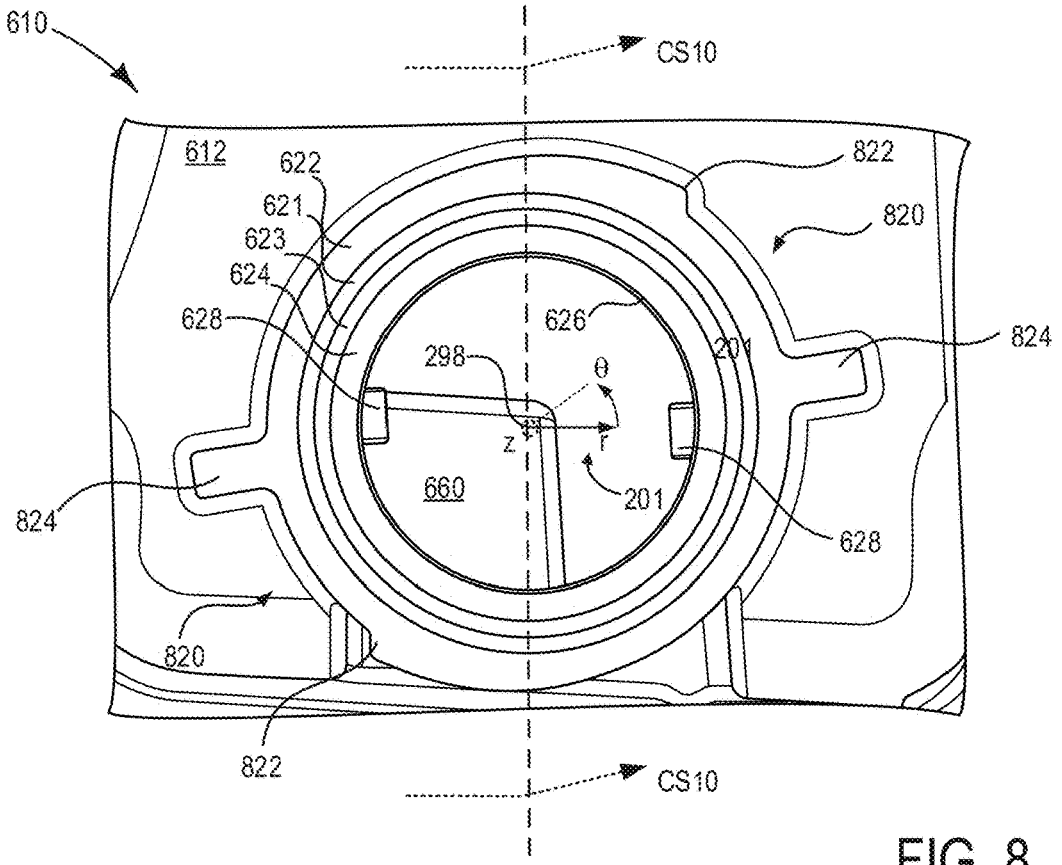
FIG. 8 shows a partial view of a fluid reservoir, including the fluid reservoir opening.
Figure 9:
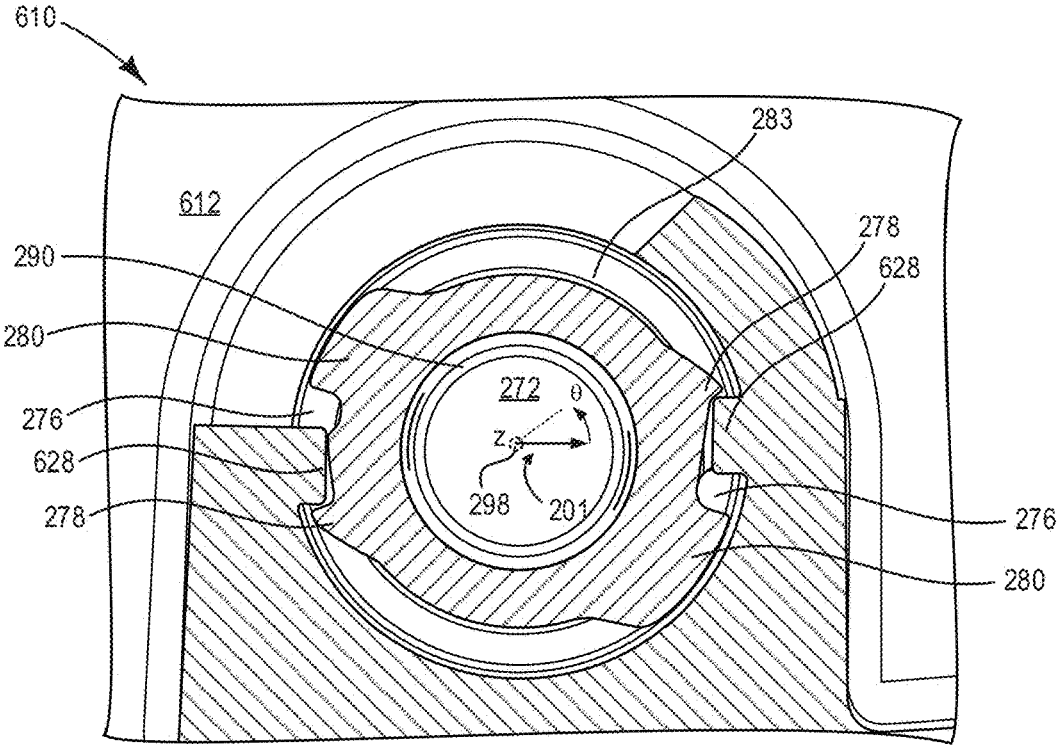
FIG. 9 shows a partial cross-sectional view, taken at section CS9 of FIG. 7, of the fluid reservoir plug of FIGS. 2-4 coupled to the fluid reservoir of FIG. 8 at the fluid reservoir opening.
Figure 10:
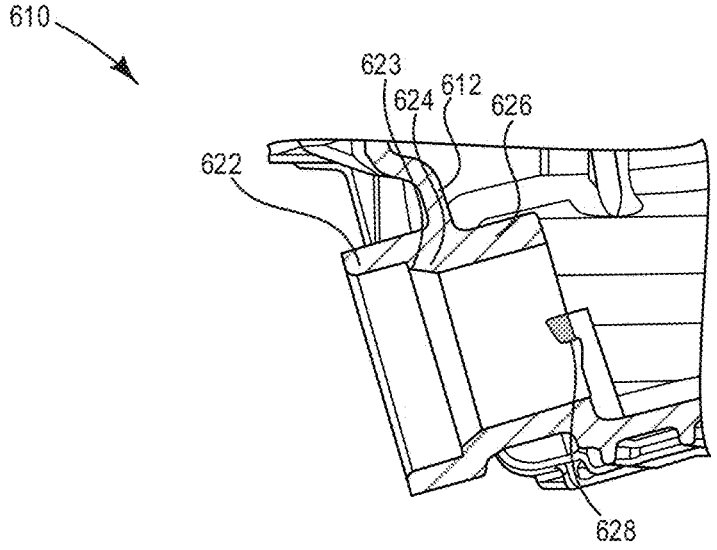
FIG. 10 shows a partial cross-sectional view, taken at section CS10 of FIG. 8, of the fluid reservoir opening of FIGS. 8 and 9.
Figure 11:
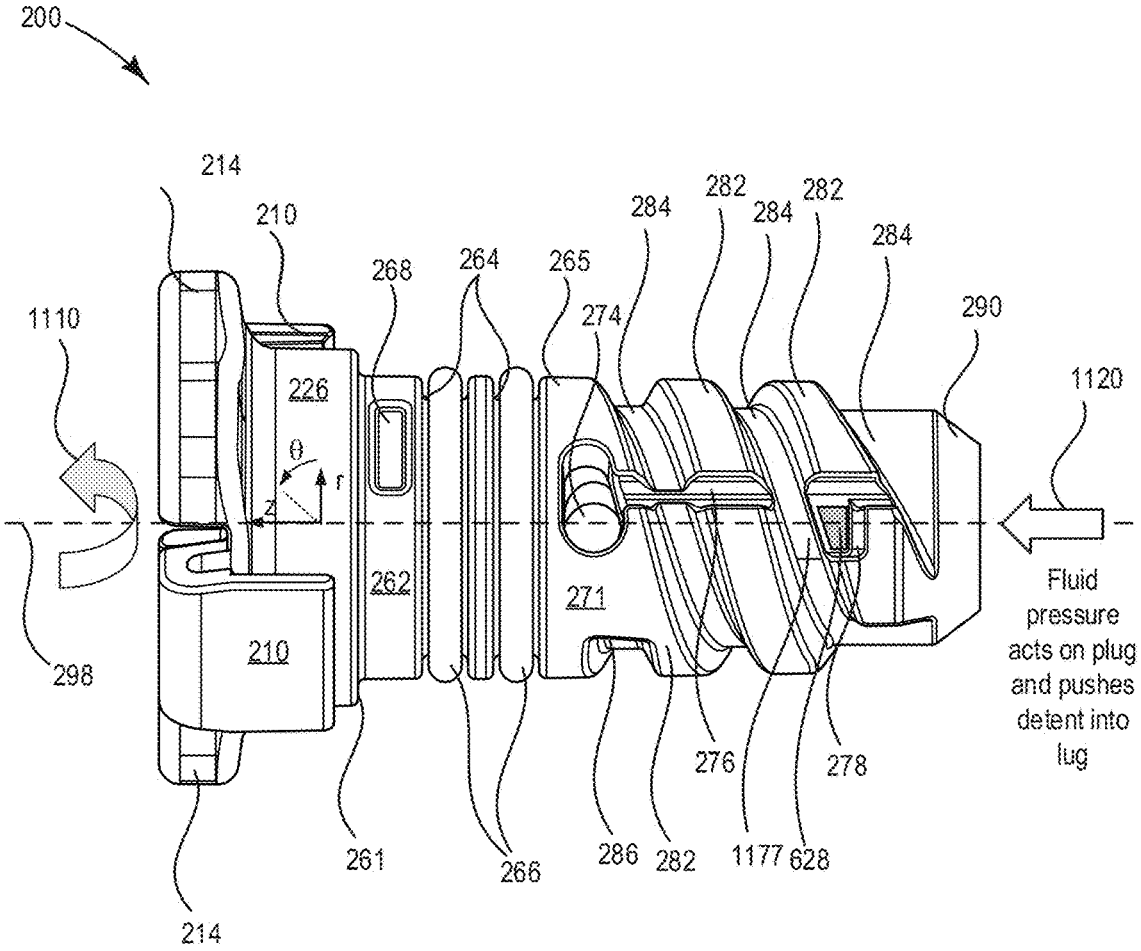
FIGS. 11-13 show side views of the fluid reservoir plug of FIG. 2 in various positions relative to the fluid reservoir opening of FIGS. 10 and 11.
Figure 12:
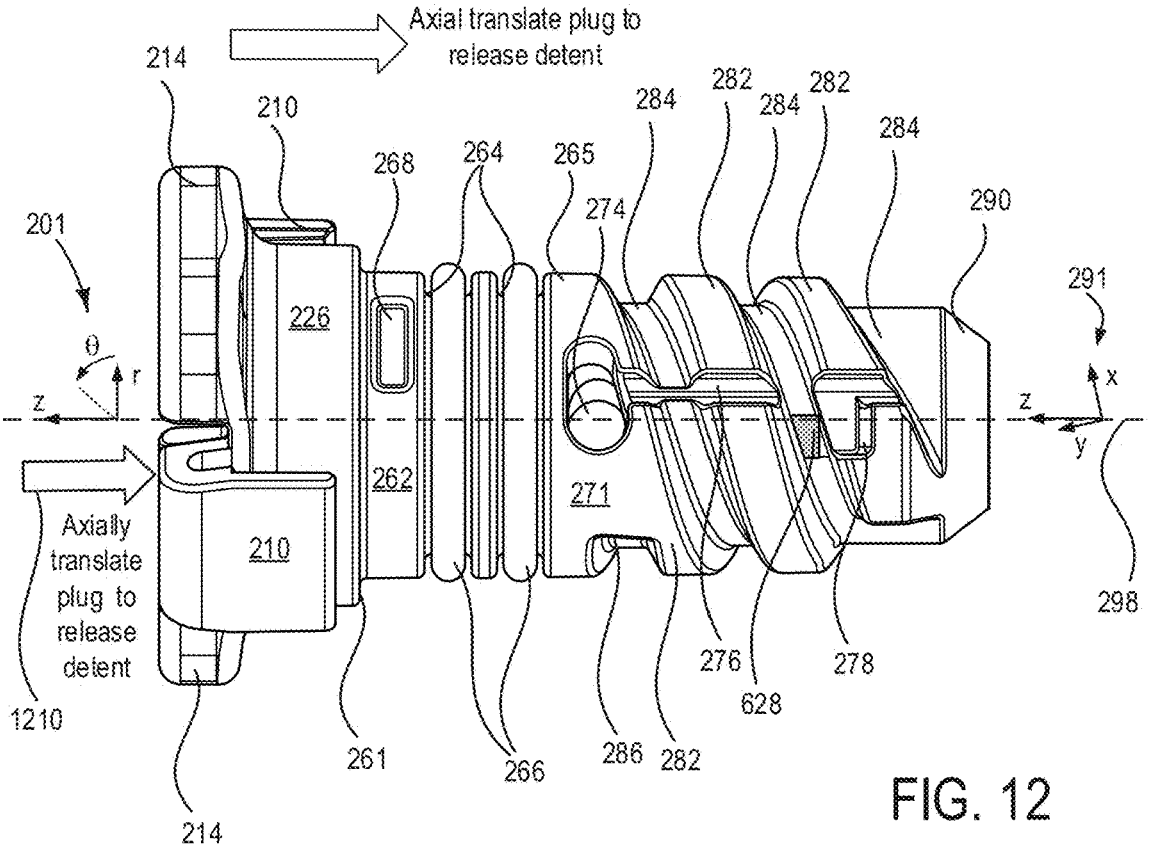
Figure 13:
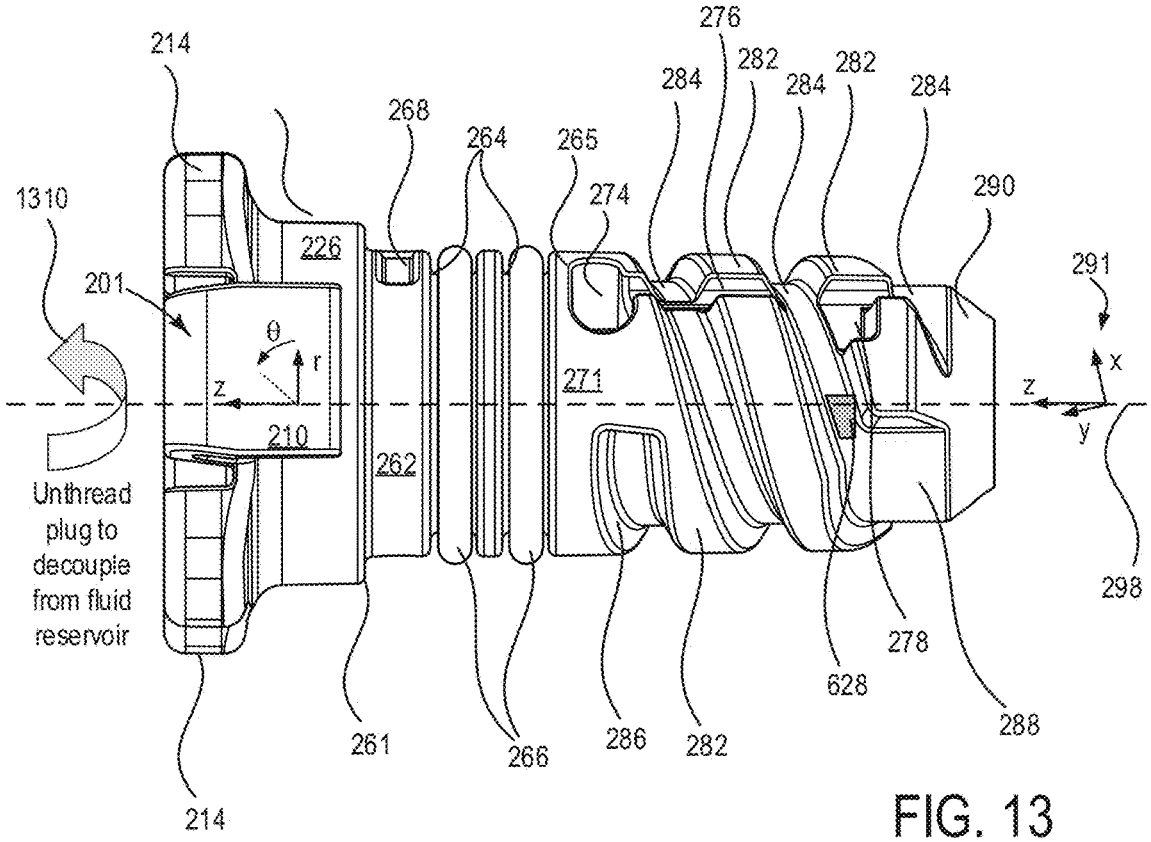
Figure 14:
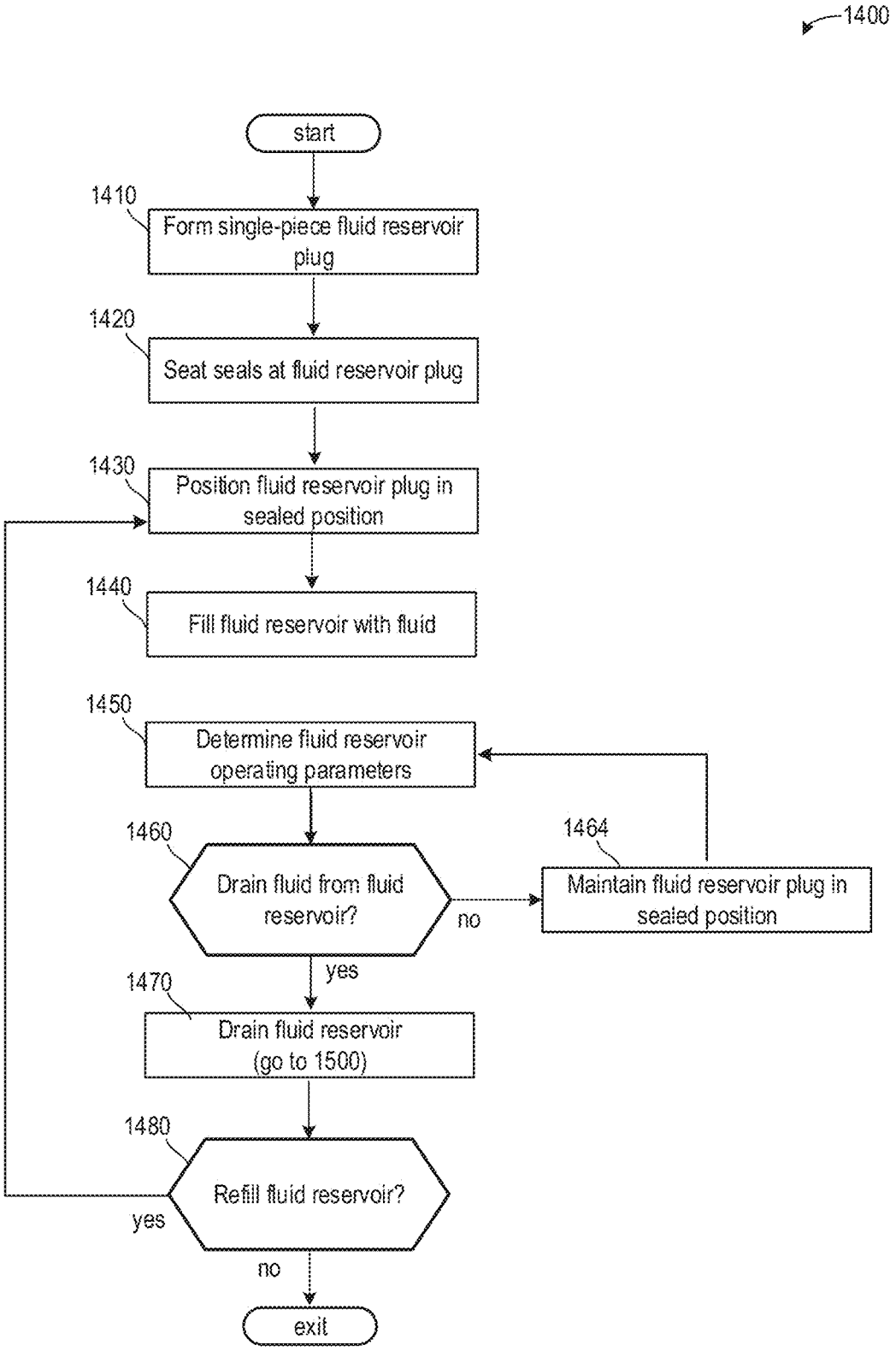
FIGS. 14-15 are flow charts representing example methods for operating the fluid reservoir plug of FIGS. 2-4.
Figure 15:
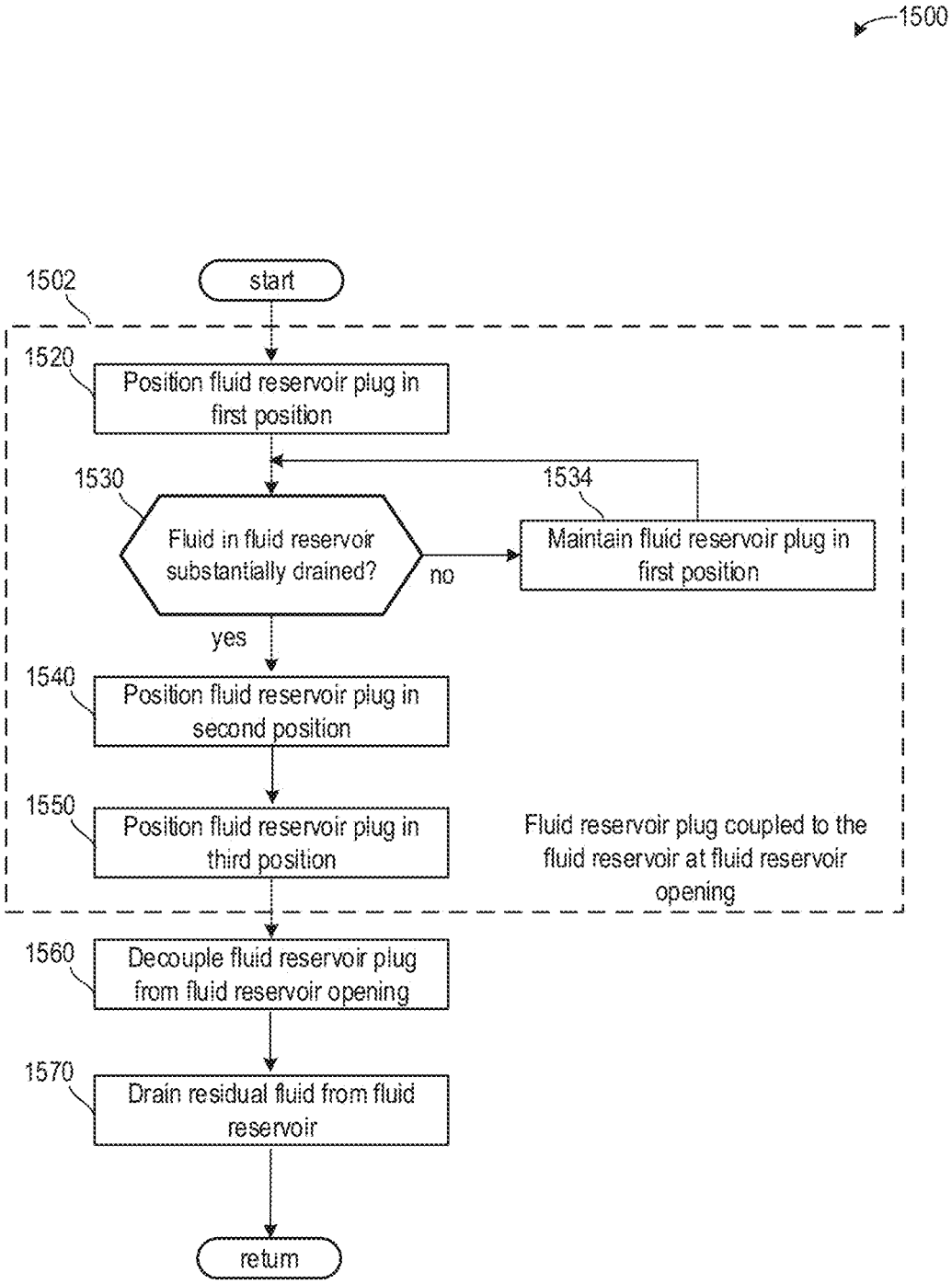

The following description relates to systems and methods for a plug for a fluid reservoir. As one example, the fluid reservoir may include an oil pan for a vehicle system, such as the vehicle system of FIG. 1. The fluid reservoir may be coupled to a plug, such as the plug of FIGS. 2-4 for sealing and draining the fluid reservoir. Fluid drains freely from a fluid reservoir opening without the fluid reservoir plug, as shown in FIG. 5A. In contrast, fluid drains from the fluid reservoir opening while the fluid reservoir plug is coupled to the fluid reservoir, as shown in FIG. 5B. Furthermore, while the fluid reservoir plug is coupled to the fluid reservoir, the plug may be positioned in a sealed position, as shown in FIG. 6. Additionally, the fluid reservoir plug may be coupled to the fluid reservoir and positioned in an unsealed position so that fluid may drain from the fluid reservoir opening, as shown in FIG. 7. A fluid reservoir opening, including lugs for coupling to the fluid reservoir plug, is depicted in FIGS. 8 and 10. In one example, the fluid reservoir plug is coupled to the fluid reservoir by threading the fluid reservoir plug onto one or more threadable attachment points positioned at the fluid reservoir opening, as shown in FIG. 9. While the plug is coupled to the fluid reservoir and the fluid reservoir opening is unsealed, detents positioned at the threading of the plug can prevent further unthreading of the fluid reservoir plug, as shown in FIG. 11. Under certain conditions, the fluid reservoir plug may be repositioned relative to the one or more lugs at the fluid reservoir opening, as shown in FIGS. 12-13. A method for operating the fluid reservoir plug is illustrated in FIGS. 14-15.

Figure 1:
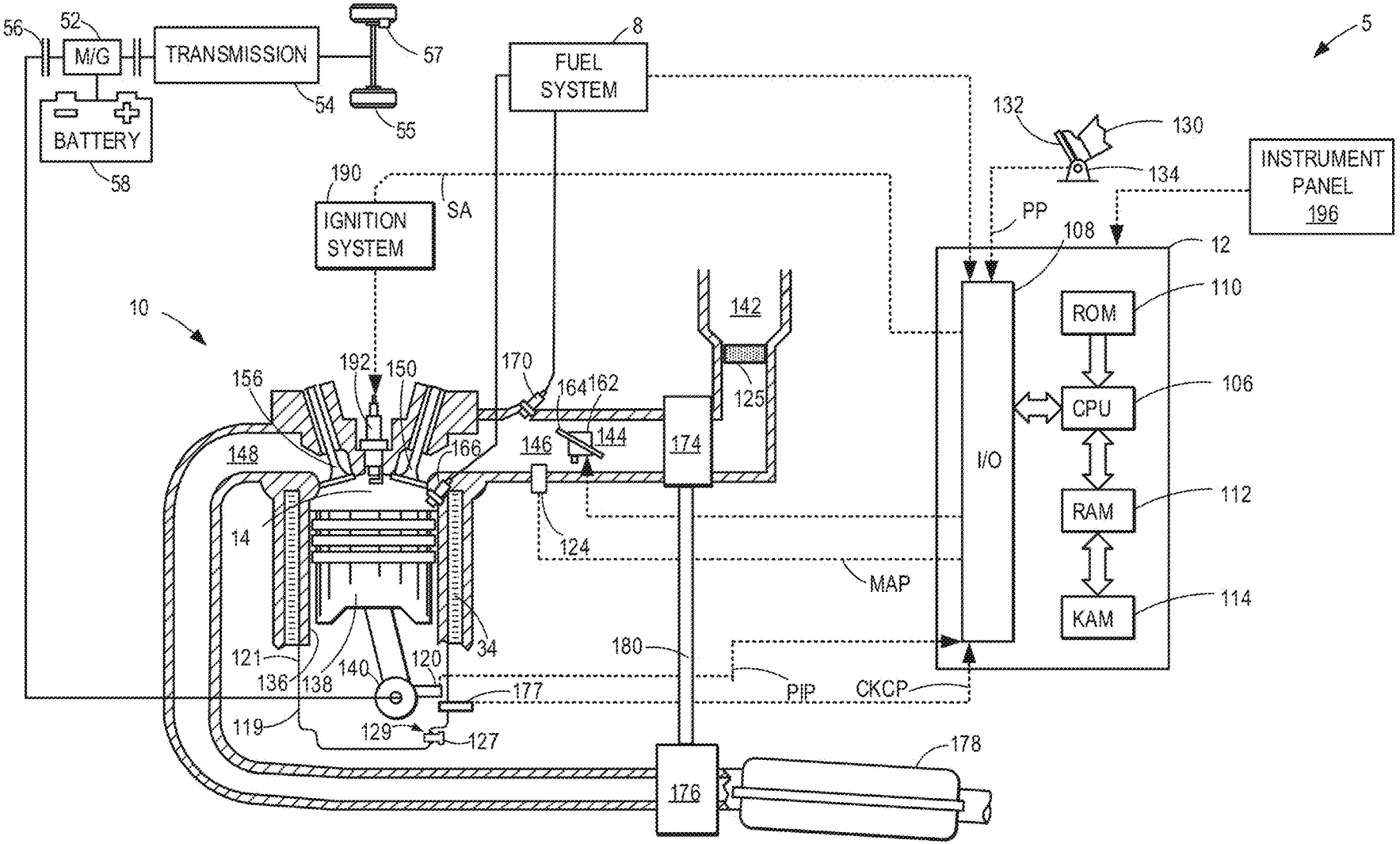
FIG. 1 shows a schematic of an engine system for a vehicle system, including a fluid reservoir.

Turning now to the figures, FIG. 1 depicts an example embodiment of a cylinder 14 of an internal combustion engine 10, which may be included in a vehicle system 5, hereinafter also described as vehicle 5. Engine 10 may be controlled at least partially by a control system, including a controller 12, and by input from a vehicle operator 130 via an input device 132. In this example, input device 132 includes a foot pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a slowing wheel caliper operation. One or more of the vehicle wheels may have a wheel speed sensor 57 mounted thereto for determining a wheel rotational speed (e.g., a number of revolutions over time) and transmitting the detected value to controller 12. Utilizing the wheel rotational speed(s), the controller 12 may compute and output a vehicle speed at an instrument panel 196.

Cylinder 14 of engine 10 can receive intake air via a series of intake air passages 142, 144, and 146. Intake air passage 146, also be described herein as intake manifold 146, can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger.

A throttle 162 including a throttle plate 164 may be provided in the engine intake passages 144 and 146 for varying the flow rate and/or pressure of intake air provided to the engine cylinders 14. For example, throttle 162 may be positioned downstream of compressor 174, as shown in FIG. 1, or may be alternatively provided upstream of compressor 174. The throttle 162 may be disposed in the engine intake to control the airflow entering intake manifold 146 and may be preceded upstream by compressor 174, for example. An air filter 125 may be positioned upstream of compressor 174 and may filter fresh air entering intake passage 142. The intake air may enter combustion chamber 14 by way of an electrically-actuated intake valve system. Likewise, combusted exhaust gas may exit combustion chamber or cylinder 14 by an electrically-actuated exhaust valve system. In an alternate embodiment, one or more of the intake valve system and the exhaust valve system may be cam-actuated. The intake and exhaust valve systems, and control thereof, are discussed in further detail herein. Exhaust passage 148 can receive exhaust gases from other cylinders of engine 10 in addition to cylinder 14.

Engine 10 may include a lower portion of the engine block, which may include a crankcase 121 encasing the crankshaft 140, and an oil pan 119 positioned below the crankshaft with oil for lubricating the crankshaft 140. The oil pan 119 may include an oil pan opening 129 for draining oil out of the oil pan 119, and a plug 127 for the oil pan opening 129. Crankcase 121 may further include an oil fill port (not shown) disposed in crankcase 121 so that oil may be supplied to the oil pan 119. A crankcase pressure (CKCP) sensor 177 may be positioned at the crankcase 121 for measuring a crankcase pressure. The CKCP signal is transmitted to the controller 12 from the CKCP sensor 177.

At an upper portion of the engine block, each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 receives signals from the various sensors of FIG. 1 and employs the various actuators of FIG. 1 to adjust engine operation based on the received signals and instructions stored on a memory of the controller. Controller 12 may receive various signals from sensors coupled to engine 10, including signals previously discussed and additionally including a measurement of; an absolute manifold pressure signal (MAP) from a MAP sensor 124. During various vehicle operating conditions, controller 12 may infer barometric pressure from the manifold pressure signal MAP. In other examples, correlations between throttle position, engine mass-airflow, and barometric pressure can be utilized in cooperation with engine breathing data. An engine speed signal, RPM, may be generated by controller 12 from a profile ignition pickup signal PIP. The manifold pressure signal MAP from MAP sensor 124 may be used to provide an indication of vacuum or pressure in the intake manifold. Controller 12 may infer an engine temperature based on the engine coolant temperature.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Figure 2:
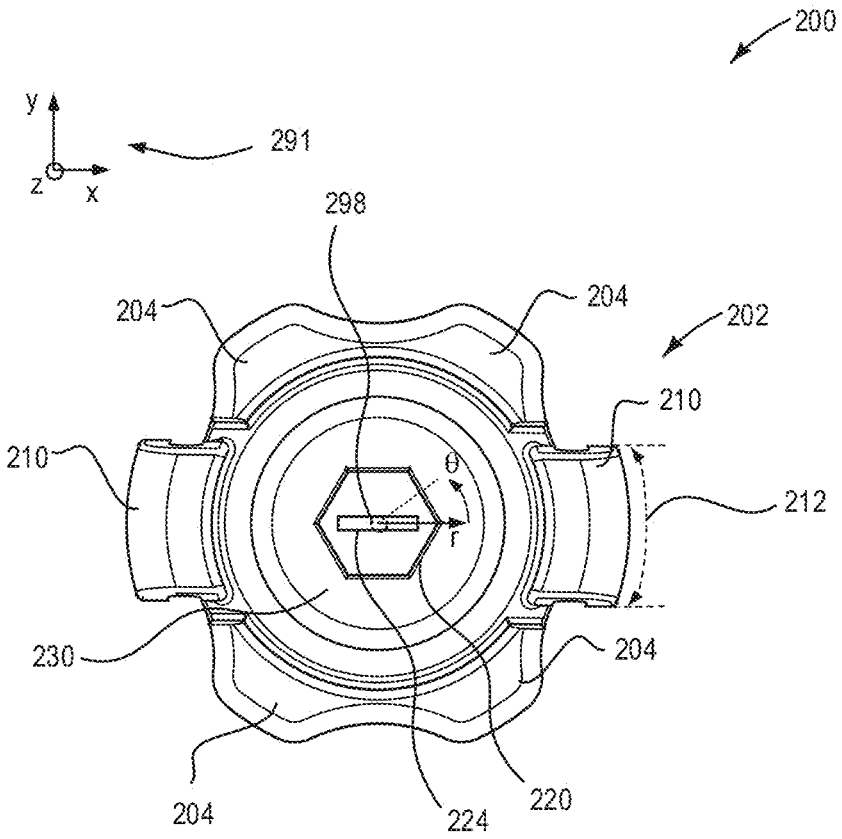
FIG. 2 shows a top view of a fluid reservoir plug for a fluid reservoir, such as the fluid reservoir of FIG. 1.
Figure 3:
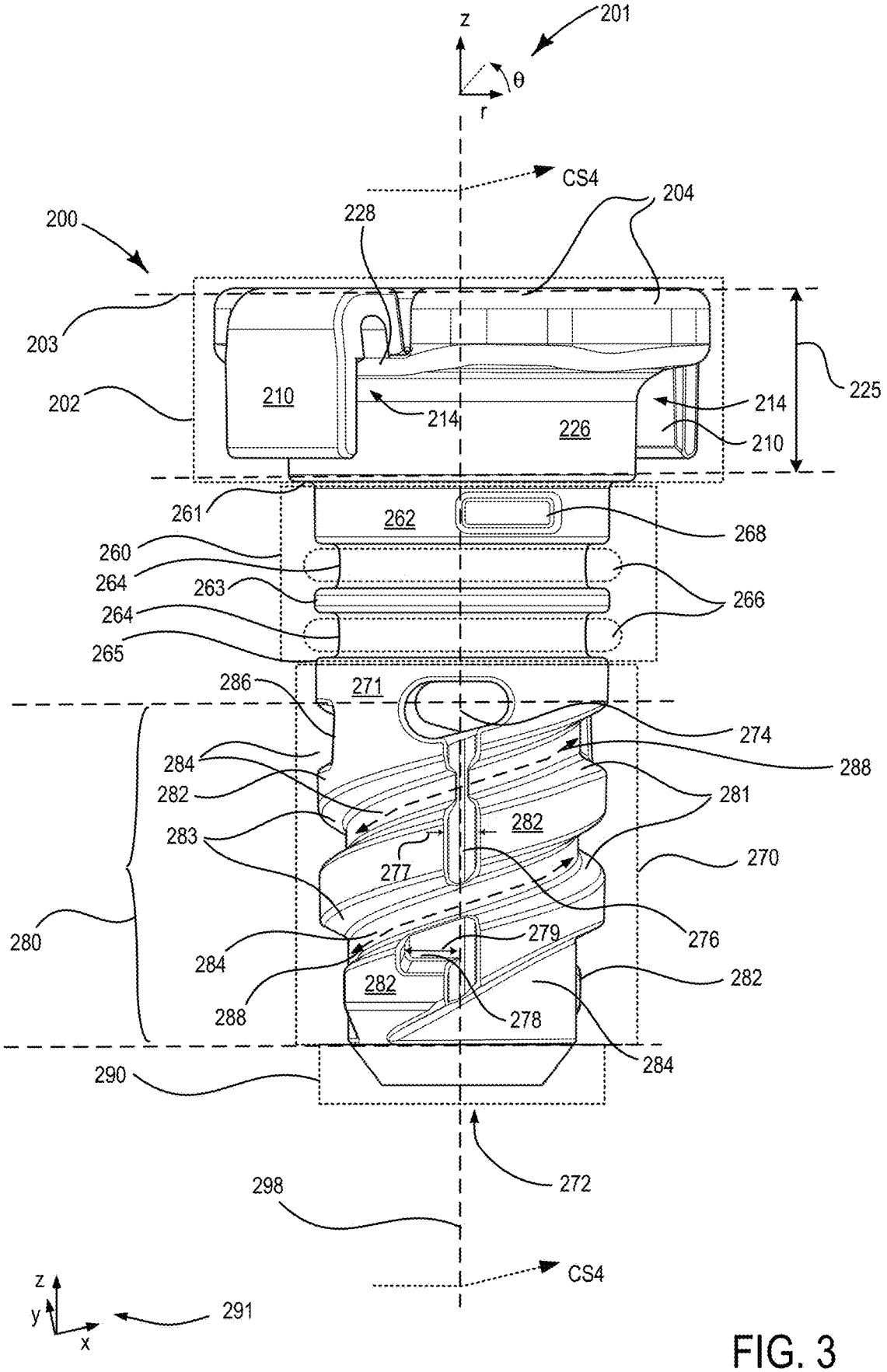
FIG. 3 shows a side view of the fluid reservoir plug of FIG. 2.

Turning now to FIGS. 2 and 3, they illustrate a top view and a side view, respectively, of a fluid reservoir plug 200, with respect to a cylindrical coordinate (z, r, θ) axis 201, and a rectangular coordinate axis (x, y, z) 291. In one example, fluid reservoir plug 200 may correspond to the plug 127 of vehicle system 5. The fluid reservoir plug 200 is a single-piece fluid reservoir plug, including a head 202, a unthreaded shaft 260, a threaded shaft 270, and a shaft tip 290, all formed from a single-piece of material. In this way, the fluid reservoir plug 200 is of a single-piece design and construction. Single-piece design and construction herein refers to the fluid reservoir plug 200 being manufactured and formed from a single piece of material, without being assembled, joined, and constructed from multiple parts. The single-piece fluid reservoir plug 200 may be formed from a single block of material through various manufacturing processes. As one example, the single-piece fluid reservoir plug 200 may be molded (e.g., injection molded, compression molded) from a single piece of continuous polymer material. In another example, the single-piece fluid reservoir plug 200 may be machined or cast from a single piece of metal, instead of fabricating it from multiple pieces and assembling them together. As non-limiting examples, the fluid reservoir plug 200 may be formed from a polyolefin such as polyethylene, polypropylene, or a copolymer thereof, or a metal such as aluminum, steel, iron, or a metal alloy, or a composite material such as a polymer composite.

Single-piece construction offers several advantages over multiple-piece construction, including increased strength and structural integrity, reduced assembly time and resources, and increased reliability due to fewer points of degradation. Additionally, products manufactured with single-piece construction have a cleaner and more seamless appearance. In the case of the fluid reservoir plug 200, single-piece construction further eliminates leakage pathways that would be present in the interstitial spaces and voids between separate pieces that are joined together in a drain plug with multiple-piece construction.

The head 202 includes a plurality of rotational drives, each of the rotational drives are shaped and positioned at the head 202 for imparting rotation about a longitudinal axis 298 in a first direction for threading (e.g., tightening) the fluid reservoir plug 200, and for imparting rotation about the longitudinal axis 298 in a second direction for unthreading (e.g., loosening) the fluid reservoir plug 200. In one example, the first direction includes a clockwise rotational direction and the second direction includes an opposite, counterclockwise rotational direction. Each of the rotational drives includes a set of protrusions and recesses that are centered around and symmetrical about the longitudinal axis 298 of the fluid reservoir plug 200. Longitudinal axis 298 (indicated by the dashed circle in FIG. 2 and the dashed line in FIG. 3) passes through a center of the head 202, unthreaded shaft 260, threaded shaft 270, and the shaft tip 290.

The rotational drives include a plurality of recessed rotational drives, including a hexagonal protrusion 220 recessed from a top surface 203 within depression 230 for receiving a hex socket wrench, and a slotted recess 224 for receiving a slotted driver. As illustrated in FIG. 2, the slotted recess 224 is positioned and centered within the hexagonal protrusion 220. Additionally, the rotational drives include a plurality of lobed lugs 204 positioned at an outer perimeter of the head 202. The plurality of lobed lugs 204 are positioned symmetrically about the longitudinal axis 298. The curvature and size of the lobed lugs 204 may be shaped to accommodate fingers for manual gripping of the head 202 and for manually rotating the fluid reservoir plug 200. In the example of FIG. 2, four lobed lugs are illustrated, however in other examples, other numbers of lobed lugs 204 may be included. For example, more than four lobed lugs 204 may be included when the outer perimeter of the head 202 is larger. The outer perimeter of the head 202 further includes tabbed protrusions 210.

Both hexagonal protrusion 220 and slotted recess 224 may be recessed within a circular depression 230 in the head 202 that is centered about longitudinal axis 298. The circular depression 230 is recessed (lower z-coordinate position) relative to a top surface 203 of the head 202, and the hexagonal protrusion 220 and the slotted recess 224 may protrude or be recessed relative to the circular depression 230. Recessing the rotational drives relative to the top surface 203 and within the circular depression 230 positions the recessed rotational drives in closer proximity to the threaded shaft 270; thus, the torque applied to drive rotation of the plug by way of hexagonal protrusion 220 and slotted recess 224 is positioned in closer proximity to the threaded shaft 270, allowing for increased mechanical advantage relative to positioning the recessed rotational drives less proximally to the threaded shaft 270.

Figure 4:
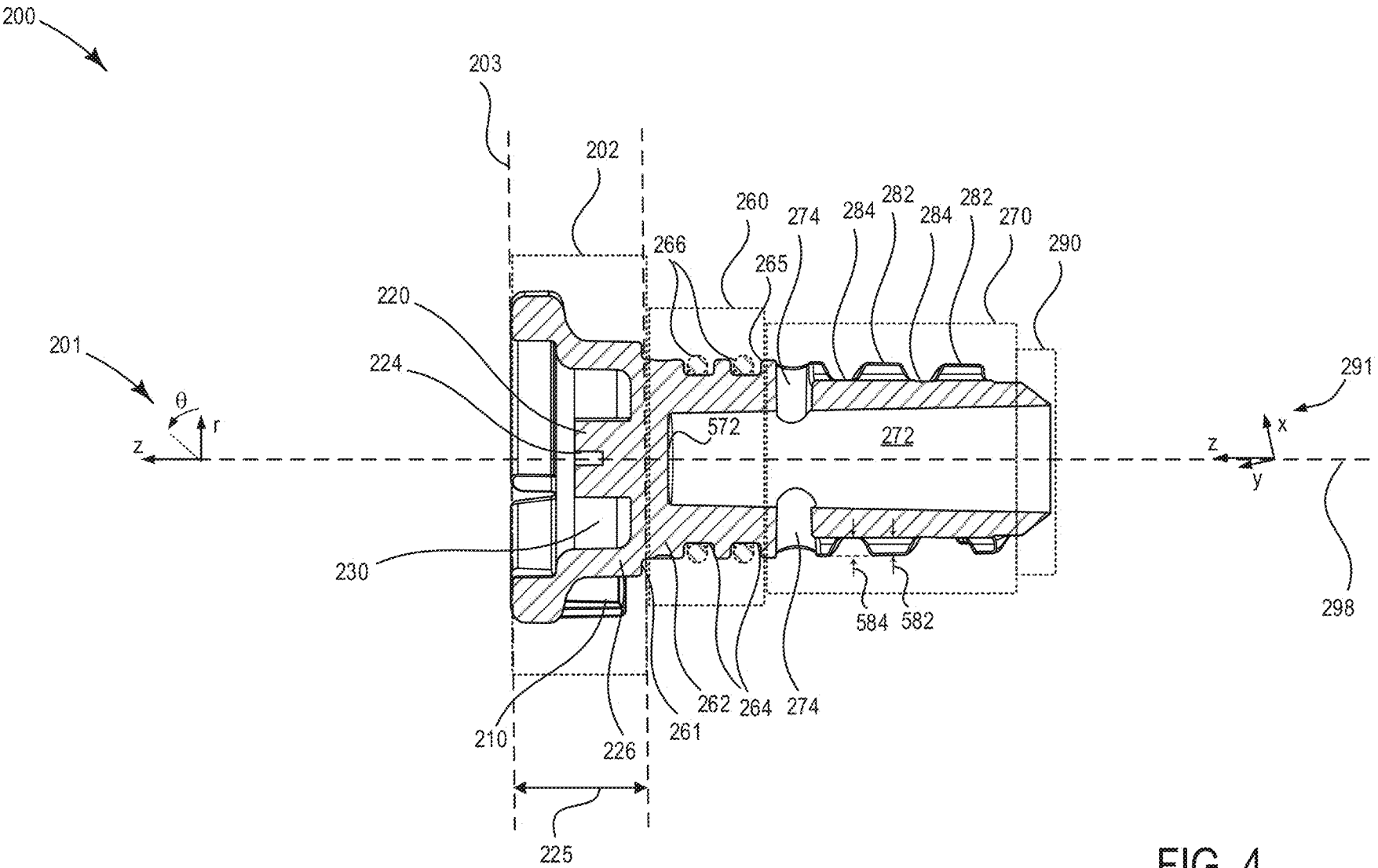
FIG. 4 shows a longitudinal cross-sectional view, taken at section CS4 of FIG. 3, of the fluid reservoir plug of FIG. 3.

As shown in FIG. 4, the hexagonal protrusion 220 and the slotted recess 224 are recessed from the top surface 203 to almost an equivalent depth 225 (e.g., decreasing z-coordinate) as a bottom edge of the collar 226 of the head 202. Furthermore, the hexagonal protrusion 220 protrudes (in the positive z-direction) from the bottom (e.g., lowest z-coordinate) of circular depression 230, and the slotted recess 224 is cut into (in the negative z-direction) the protrusion forming the hexagonal protrusion 220. The bottom of the circular depression 230 may be positioned at a substantially equivalent z-coordinate depth 225 as the bottom of the collar 226. Hexagonal protrusion 220 and slotted recess 224 are non-limiting examples of recessed rotational drives included in the head 202. In other examples, the recessed rotational drives may include one or more of a cross drive, square drive, star-shaped drive (e.g., torx drive), a double hex drive, and the like. A radial position (e.g., r-coordinate relative to the longitudinal axis 298) of the lobed lugs 204 may be greater than an outer radius of the threaded shaft 270 to increase a manual torque applied to the lobed lugs 204 to rotate the fluid reservoir plug 200.

Tabbed protrusions 210 extend radially outwards (increasing r-coordinate direction) before extending downwards (decreasing z-coordinate direction) from the top surface 203, forming spaces 214 under and between the tabbed protrusions 210 and a collar 226 of the head 202. The tabbed protrusions 210 may extend downwards from the top surface 203 almost to the depth (in the z-coordinate direction) 225 of the collar 226. A top of the tabbed protrusions 210 may be flush with a top of the lobed lugs 204 so that the top of the head 202 is flat and flush with the top surface 203, except for the circular depression 230, the slotted recess 224, and the hexagonal protrusion 220. As shown in FIG. 3, the collar 226 has an outer diameter (in the r-coordinate dimension) that is less than a radial position of the lobed lugs 204 and the tabbed protrusions 210, but greater than an outer diameter of each of the unthreaded shaft 260, the threaded shaft 270, and the shaft tip 290.

A depth (in the z-coordinate direction) of the head 202 includes a depth of the lobed lugs 204 and a depth of the collar 226. In the non-limiting example of FIG. 3, a depth of collar 226 (in the z-coordinate direction) is greater than a depth of the lobed lugs 204. Furthermore, as illustrated in FIG. 6, a depth of the collar 226 may match a depth of a lip 622 of the fluid reservoir opening 620. Each of the collar 226, lobed lugs 204, tabbed protrusions 210, hexagonal protrusion 220, slotted recess 224, and the circular depression 230 exhibit rotational symmetry (with respect to rotational angle, θ) about the longitudinal axis 298.

In one example, a size of the rotational drives, including the hexagonal protrusion 220 and the slotted recess 224, may be selected to facilitate receiving common hand tools. Furthermore, the dimensions of the rotational drives may be selected to mitigate degradation of the head 202 when threading and unthreading the fluid reservoir plug 200. In one example, the hexagonal protrusion 220 may include an 8 mm hexagonal drive and the slotted recess 224 includes a 3/16 inch slotted screwdriver drive. Increasing a size of the hexagonal protrusion 220 above 8 mm may increase susceptibility of the fluid reservoir plug 200 to overtorqeing and degradation of the fluid reservoir plug 200. As one example, when the hexagonal drive 220 includes an 8 mm hexagonal drive, during overtorqueing, the hexagonal drive 220 may round off prior to degradation of the fluid reservoir plug 200, such as degradation of the tabbed protrusions 210; when the hexagonal drive 220 includes a 10 mm hexagonal drive, during overtorqueing, the tabbed protrusions 210 may be degraded prior to rounding off of the hexagonal drive 220. Rounding off of the hexagonal drive 220 (e.g., wearing of the hexagonal head to a round head) prior to degradation of the tabbed protrusions 210 may increase a useful life of the fluid reservoir plug 200 since the fluid reservoir plug 200 may still be threaded and unthreaded by way of the other rotational drives, including the slotted recess 224 and the lobed lugs 204.

The unthreaded shaft 260 is positioned directly between the head 202 and the threaded shaft 270, with no other intervening elements therebetween. The unthreaded shaft 260 includes a collar 262 and plurality of grooves 264. The unthreaded shaft 260, including the collar 262 and the plurality of grooves 264, is rotationally symmetrical about longitudinal axis 298, except for a notch 268 in the collar 262. In one example, notch 268 may include a product code or emblem may be engraved or placed thereat. In this way, the collar 262 and the grooves extend circumferentially around the fluid reservoir plug 200. An outer diameter of the unthreaded shaft (e.g., dimension in the r-coordinate), other than at the plurality of grooves 264, is less than a collar 226, and equivalent to an outer diameter of the threaded shaft 270. As such, where the collar 262 abuts collar 226, a lip 261 extends circumferentially around (and exhibiting rotational symmetry around longitudinal axis 298) the fluid reservoir plug 298.

Each of the plurality of grooves 264 is dimensioned and shaped to position a seal 266 such as an o-ring or gasket therein. When placed at the grooves 264, each of the seals 266 extend around the entire circumference of the grooves 264, and are rotationally symmetrical about longitudinal axis 298. The seals 266 may include a single, continuous seal without joints or seams, to reduce fluid leakage paths through the seals 266. A position of the seals 266 when placed at the plurality of grooves 264 is indicated by dashed lines in FIGS. 3 and 4. In other words, each of the plurality of grooves 264 may be formed having a thickness (r-coordinate dimension) and a depth (z-coordinate dimension) for placing a corresponding seal 266. As shown in FIGS. 3 and 4, when the seals 266 are placed in each of the plurality of grooves 264, an outer diameter (e.g., dimension in the r-coordinate) of the placed seal 266 is greater than an outer diameter of the unthreaded shaft 260. In this way, when the fluid reservoir plug 200 is coupled to and placed in a fluid reservoir opening 620 (e.g., positioned in the sealed position), each of the seals 266 is engaged with the fluid reservoir 610. Engaging each of the seals 266 with the fluid reservoir includes each of the seals 266 being compressed between the grooves 264 and the walls of the fluid reservoir opening 620 so that the compressed seals 266 form a seal between each of the plurality of grooves 264 and the walls of the fluid reservoir opening 620, thereby obstructing fluid flow from the threaded shaft past the seals 266. As such, when the seals 266 are engaged, the seals 266 seal the fluid reservoir opening 620. In the non-limiting example of FIG. 3, one of the plurality of grooves 264 is positioned directly adjacent to the threaded shaft 270 such that a step or lip 265 is formed around a circumference of the fluid reservoir plug 200 where the unthreaded shaft 260 abuts to the threaded shaft 270. In the non-limiting example of FIG. 3, fluid reservoir plug 200 includes two grooves 264 for placing two seals 266, however, in other examples, more than two grooves 264 may be included for placing more than two seals 266.

In FIGS. 3-4, the seals 266 are depicted with dashed lines. After forming the head 202, unthreaded shaft 260, threaded shaft 270, and the shaft tip 290 from a single-piece of material, the seals 266 may be placed at each of the plurality of grooves 264 prior to coupling of the fluid reservoir plug 200 at the fluid reservoir 610.

The threaded shaft 270 is positioned directly between the unthreaded shaft 260 and the shaft tip 290, with no other intervening elements therebetween. The threaded shaft 270 includes an upper collar 271, a threading 280, one or more channels 276, one or more conduits 274, and a detent 278. The threading 280 forms a helical winding around the outer surface of the threaded shaft 270, the threading 280 extending across a length (z-coordinate direction) of the threaded shaft 270 from just below where the threaded shaft 270 abuts the unthreaded shaft 260 to where the threaded shaft 270 abuts the shaft tip 290. The threading 280 includes a helical groove 284 and a helical ridge 282 forming the root and the crest of the threading 280, respectively. A cross-sectional shape (in a plane perpendicular to the helices of the helical groove 284 and helical ridge 282) of the helical groove 284 and the helical ridge 282 are defined by the upper flank 281, lower flank 283, a transverse width of the helical groove, and the flank angles of the upper flank 281 and the lower flank 283.

The helical ridge 282 and the helical groove 284 extend from a threading terminus 286 (near the unthreaded shaft) to the shaft tip 290, forming multiple revolutions of thread windings around the threaded shaft 270. The helical ridge 282 is raised (in the r-coordinate) relative to the helical groove 284. Said another way, the helical groove 284 is recessed (in the r-coordinate) relative to the helical ridge 282.

In this way, when the fluid reservoir plug 200 is coupled to the fluid reservoir 610, positioning the fluid reservoir plug 200 in a sealed position includes rotating the fluid reservoir plug 200 (in a first direction) a plurality of revolutions until each of the seals 266 are engaged. Similarly, when the fluid reservoir plug 200 is coupled to the fluid reservoir 610, positioning the fluid reservoir plug 200 in an unsealed position includes rotating the fluid reservoir plug 200 (in a second direction) a plurality of revolutions until each of the seals 266 is disengaged. Furthermore, in order to accommodate the multiple revolutions of windings, a length (in the z-coordinate) of the threaded shaft 270 (and a length of the fluid reservoir plug 200) may be longer relative conventional plugs. Increasing a length of the threaded shaft 270 relative to conventional plugs, and increasing a separation distance between the plurality of seals 266 and the last winding of the threading 280 proximal to the shaft tip 290 may aid in positioning the fluid reservoir plug 200 in the unsealed position while the fluid reservoir plug 200 remains coupled to the fluid reservoir 610.

The upper collar 271 includes the portion of the threaded shaft 270 beyond the terminus 286 and above (relative to the z-coordinate) all the windings of the threading 280. As illustrated in FIG. 3, a pitch of the threading 280 may be uniform such that the helical ridge 282 and the helical groove 284 remain parallel as they helically wind around the threaded shaft 270. Furthermore, a shape and dimensions of the helical groove 284 and the helical ridge 282 may be designed to accommodate threading of the fluid reservoir plug 200 at the fluid reservoir opening 620, as further described herein with respect to FIGS. 6 and 7. In other words, a cross-sectional area of the volume formed by the helical groove 284, the helical ridge 282, and the walls of opening 620 may accommodate a cross-sectional area of an attachment point such as a lug 628 (see FIGS. 6-13) when the fluid reservoir plug 200 is coupled at a fluid reservoir opening 620. In other words, as the fluid reservoir plug 200 is threaded onto or unthreaded from the fluid reservoir opening 620, the lug 628 slides along the helical groove 284 and the helical ridge 282 (e.g., following the path of the dotted arrows 288). In this way, the lug 628 is a threadable attachment point for threading on to the threading 280 of the fluid reservoir plug 200.

Threading the threading 280 on to the lug 628 may include imparting a pushing force (to push the fluid reservoir plug 200 into the fluid reservoir opening 620) on the head 202 in the negative z-coordinate direction. Thus, threading the threading 280 on to the lug 628 may include pressing a lower flank 283 of the helical ridge 282 against the lug 628 as the lug 628 slides upwards (positive z-coordinate direction) and around the helical groove 284 relative to the fluid reservoir plug 200. Unthreading the threading 280 from the lug 628 may include imparting a pulling force (to pull the fluid reservoir plug 200 out of the fluid reservoir opening 620) on the head 202 in the positive z-coordinate direction. Furthermore, while the fluid reservoir 610 contains fluid, a hydrostatic fluid pressure may impart a force on the fluid reservoir plug 200 in the positive z-direction. Thus, unthreading the threading 280 from the lug 628 may include the upper flank 281 of the helical ridge 282 pressing against the lug 628 as the lug 628 slides downwards (negative z-coordinate direction) and around the helical groove 284 relative to the fluid reservoir plug 200.

The detent 278 includes one or more structures coupled to the fluid reservoir plug 200 that are configured to halt an unthreading of the fluid reservoir plug 200 at the fluid reservoir opening 620. In the example of FIG. 3, the detent 278 is includes a notch cut out from the helical ridge 282 proximal to the shaft tip 29. In particular, the detent 278 includes a notch cut out from an upper flank 281 in the winding of the helical groove 284 that is most proximal to the shaft tip 290. As such, the detent 278 does not interfere or obstruct a threading of the fluid reservoir plug 200 at the fluid reservoir opening 620. Rather, the detent 278 halts the unthreading of the fluid reservoir plug 200 only when the one or more lugs 628 slides against the last winding of threading proximal to the shaft tip 290. In this way, the detent 278 halts the unthreading of the fluid reservoir plug 200 only when all but the last winding of the threading 280 (proximal to the shaft tip 290) is unthreaded from the one or more lugs 628 and the seals 266 are disengaged from the fluid reservoir opening 620, as further described with respect to FIGS. 7-13. Said another way, while the detent makes face-sharing contact with the threadable attachment point, the single-piece plug is unthreadable from the threadable attachment point.

In the non-limiting example of FIG. 3, the detent 278 is fluidly coupled to the channel 276, however, in other examples, the detent 278 may be positioned away from the channel 276. In a non-limiting example, the fluid reservoir plug 200 may include two detents 278 positioned symmetrically about the longitudinal axis 298. Positioning the detent 278 adjacent to the channel 276 may aid in sliding the lug 628 into the detent 278 during unthreading of the fluid reservoir plug 200 because the effective width of the detent 278 is increased by the width of the channel 276. Furthermore, positioning the detent 278 adjacent to the channel 276 may aid in simplifying manufacturing of the fluid reservoir plug 200, for instance, during an injection molding manufacturing process. In other examples, the detent 278 may be positioned away from the channel 276; for example, the detent 278 may be positioned on the shaft at a θ-coordinate position of 90 degrees relative to the channel 276. In other examples, the detent 278 may be positioned away from the channel 276 at a position on the shaft at a θ-coordinate position of greater or less than 90 degrees relative to the channel 276. For the case where the fluid reservoir plug 200 includes a plurality of detents 278, each of the plurality of detents 278 may be positioned symmetrically, with respect to the θ-coordinate, about the longitudinal axis 298. Additionally, each of the plurality of detents 278 may be aligned at an identical z-coordinate position on the fluid reservoir plug 200, so that each of the plurality of detents 278 make face-sharing contact with one the lugs 928 simultaneously as the fluid reservoir plug 200 is unthreaded to the unsealed position.

An outer diameter (e.g., dimension in the r-coordinate) of the threaded shaft 270 is equivalent to an outer diameter of the collar 262, except for at the helical groove 284, the one or more channels 276, and the one or more conduits 274. As shown in FIG. 3, each of the one or more channels 276 extend transversely across the threading 280 at the external surface of the fluid reservoir plug 200, such that a continuity of the helical ridge 282 is interrupted (e.g., the helical ridge 282 is discontinuous) once per revolution of winding around the threaded shaft 270 for each of the channels 276. Said another way, each of the channels 276 extend through each thread (e.g., revolution of helical winding) along the entire length of the threaded shaft 270. The thickness (in the r-coordinate) of the one or more channels 276 may be substantially equivalent to a thickness 582 (in the r-coordinate) of the helical ridge 282 and a thickness 584 of a helical groove 284 so that the bottom of the one or more channels 276 may coincide with the helical groove 284; as such, during threading or unthreading of the fluid reservoir plug 200, the one or more channels 276 do not catch or snag, and thereby disrupt a fluidity and smoothness of the threading and unthreading of the fluid reservoir plug 200. A cross-section of the one or more channels 276 may be u-shaped, as suggested in FIG. 3, however, in other examples, the cross-section of the one or more channels 276 may be other than u-shaped. A width 277 of the channels 276 may be less than a width 279 of detent 278, and less than a width of the lugs 628 so that the lugs 628 do not snag or catch on the channels 276 during threading and unthreading of the lugs 628. In other words, while the channel 276 may be dimensioned to be shallow and narrow enough to reduce interfering with threading and unthreading of the fluid reservoir plug 200; however, a width (in the q-coordinate) and a dimension (in the r-coordinate) of the channel 276 may both be increased to aid in increasing fluid flow therethrough when the fluid reservoir plug 200 is positioned in the unsealed position.

A length of the detent 278 (a length in the z-coordinate relative to the upper flank 281 of the helical groove 284) may be large enough such that the lug 628 makes sufficient face-sharing contact with the detent 278 so that when the lug 628 is placed inside the detent 278, further unthreading of the fluid reservoir plug 200 is halted. In one example, a length of the detent 278 may be substantially equivalent to a length (z-coordinate) of the lug 628, as illustrated in FIGS. 11-13. Furthermore, forming the detent 278 with a shape that matches a shape of the lug 628 may aid in increasing face-sharing contact with the detent 278 so that when the lug 628 is placed inside the detent 278, further unthreading of the fluid reservoir plug 200 is halted. In the examples of FIGS. 11-13, the detent 278 and the lug 628 are trapezoidal in shape and substantially equivalent in dimension.

Each of the one or more channels 276 extend across the threading 280 to a different one of the one or more conduits 274. In this way, each of the one of more channels 276 is fluidly connected to a different one of the conduits 274, wherein the number of channels 276 is equivalent to the number of conduits 274. In the non-limiting example of FIG. 3, the threaded shaft 270 includes two channels 276 and two conduits 274, each pair of corresponding channel 276 and conduit 274 positioned diametrically opposite to one another. In other examples, the number of channels and conduits may be greater than two. A larger number of channels and conduits may allow for higher fluid flow through the fluid reservoir plug 200, but may increase manufacturing complexity and resources.

Each of the one or more conduits 274 may be positioned (relative to the z-coordinate) between the last revolution of winding of the helical groove 284 and the groove 264 of the unthreaded shaft 260 positioned most proximally to the threaded shaft 270. In other words, the conduits 274 may be positioned at an upper collar 271 of the threaded shaft 270. In the example of FIG. 3, the upper collar 271 includes the portion of the threaded shaft 270 between the last revolution of winding of the helical groove 284 and the unthreaded shaft 260.

A cross-sectional area of the one or more conduits 274 may be ovular, as shown in FIG. 3. In other examples the cross-sectional area of the one or more conduits 274 may be circular. For a corresponding channel 276 fluidly coupled to a conduit 274, at least one of the dimensions of the cross-sectional area of the conduit 274 may be greater than a width of the channel 276, thereby facilitating flow of fluid from the channel 276 to the conduit 274. The conduits 274 extend completely through a wall thickness (in r-coordinate dimension) of the threaded shaft 270 such that they fluidly connect the channels 276 with a cavity 272. In this way, a longitudinal axis through the conduit 274 may be substantially directed in the radial direction, and may be perpendicular to a longitudinal axis of the channel 276

As shown in FIG. 4, the fluid reservoir plug 200 further includes a cavity 272 extending from the threaded shaft 270, through the unthreaded shaft 260, and through the shaft tip 290. As such, each of the shaft tip 290, the threaded shaft 270 and the unthreaded shaft 260 are hollow elements, and the shaft tip 290 is open at its end. The cavity 272 is rotationally symmetrical about longitudinal axis 298, thereby forming a cylindrical hollow space inside the fluid reservoir plug 200. As shown in FIG. 4, the cavity 272 may include an open, tapered circular cylinder, whereby a cross-section of the cavity 272 across its length (with respect to z-coordinate) may be continuously tapered as the cavity 272 progresses (in a positive z-coordinate) from the shaft tip 290 to an interior face 572. In other examples, the cavity 272 may form a regular circular cylinder, whereby the cross-section of the cavity 272 across its length (with respect to z-coordinate) may be constant as the cavity 272 progresses (in a positive z-coordinate) from the shaft tip 290 to an interior face 572. The walls of the cavity 272 may be continuous and smooth, without steps, corners, or edges, to facilitate flow of fluid therethrough and to discourage back flow and/or stagnant flow patterns therein.

Inside the fluid reservoir plug 200, the cylindrical walls of the cavity 272 may abut at the interior face 572. The interior face 572 may be positioned (relative to the z-coordinate) to be aligned with the collar 262 of the unthreaded shaft 260. In this way, the cavity 272 extends inside the fluid reservoir plug 200 from the shaft tip 290 through the threaded shaft 270 and the unthreaded shaft 260 past the one or more conduits 274. In this way, the one or more conduits 274, are fluidly connected to the cavity 272, and to the channels 276. Furthermore, when the fluid reservoir plug 200 is coupled to a fluid reservoir 610, fluid from an interior of the fluid reservoir 610 is able to flow past the fluid reservoir plug by way of the one or more channels 276, the hollow cavity 272, and the one or more conduits 274. Further still, the inner walls of the unthreaded shaft 260, the threaded shaft 270, and the shaft tip 290 together form a cylinder open at one end (at the shaft tip 290), and with openings in the inner walls at each of the conduits 274.

The shaft tip 290 abuts directly to the threaded shaft 270 at a position distal to the position where the threaded shaft 270 abuts directly to the unthreaded shaft 260. The shaft tip 290 has a tapered profile (shaft tip tapers with respect to the r-coordinate as the z-coordinate decreases), moving long the shaft tip 290 distally from the threaded shaft 270. The shaft tip 290 tapers from an outer diameter of the threaded shaft 270 to an outer diameter of the cavity 272 at the distal end of the fluid reservoir plug 200. A tapered shaft tip 290 facilitates centering and positioning the fluid reservoir plug 200 for threading onto a fluid reservoir opening 620, by helping to guide and direct the lug 628 into to the threading 280.

Including the cavity 272 in the fluid reservoir plug 200 aids in easing manufacturing of the fluid reservoir plug 200. For example, including the cavity 272 reduces a mass of the fluid reservoir plug 200. Furthermore, during injection molding, the cavity 272 may serve as a receptacle for a core pin. Utilizing a core pin may aid in achieving increased precision and resolution of various features such as the threading 280, channel 276, and grooves 264 during injection molding. Forming cavity 272 may further achieve a more uniform wall thickness along the length (in the z-coordinate) of the fluid reservoir plug 200 from the shaft tip 290 to the interior face 572 of the unthreaded shaft 260, which further aids in ease of manufacturing, for example increasing manufacturing reliability. Extending the cavity 272 from the shaft tip 290 to the threaded shaft 270, and beyond the conduits 274 to the unthreaded shaft 260 also aids in manufacturing precision of the grooves 264. Increasing manufacturing precision of the unthreaded shaft 260, including the grooves 264, helps in increasing a reliability in sealing performance of the seals 266 when the fluid reservoir plug 200 is positioned in the sealing position.

Turning now to FIGS. 6 and 7, they illustrate schematics 600 and 700 showing partial views of a fluid reservoir 610, with the fluid reservoir plug 200 coupled to the fluid reservoir 610 at the fluid reservoir opening 620. In addition, schematics 600 and 700 show seals 266 placed at each of the plurality of grooves 264 of the fluid reservoir plug 200. In one example, the fluid reservoir 610 corresponds to an oil pan 119. The fluid reservoir opening 620 protrudes externally from the walls 612 of the fluid reservoir 610. Furthermore, the fluid reservoir opening 620 includes an outer lip 622, a shoulder 623, an inner collar 624, and an interior wall 626, each defining a cylindrical space therein (tapered or regular) for receiving the fluid reservoir plug 200. Further still, the fluid reservoir opening 620 includes one or more threadable attachment points (e.g., lugs 628) coupled at the interior end of the interior wall 626. In the case where the fluid reservoir opening 620 includes a plurality of lugs 628, the lugs 628 may be evenly spaced about the interior end of the interior wall 626 so that the plurality of lugs 628 are rotationally symmetrical about the longitudinal axis 298. As illustrated in FIGS. 7-9, the lugs 628 protrude inward (in a negative r-coordinate direction) from the interior wall 626 of the fluid reservoir opening 620. As such, when the fluid reservoir plug 200 is inserted into the fluid reservoir opening 620 and rotated in first direction, the lugs 628 thread into the threading 280, thereby coupling the fluid reservoir plug 200 to the fluid reservoir 610 at the fluid reservoir opening 620.

The outer lip 622, the shoulder 623, and the inner collar 624 are positioned exteriorly relative to the walls 612 of the fluid reservoir 610, while the interior wall 626 is positioned interiorly relative to the walls 612 of the fluid reservoir 610. As such, when the fluid reservoir 610 is sealed, the fluid in the fluid reservoir 610 is fluidly connected to the fluid reservoir opening 620 only at the interior wall 626. Fluid reservoir 610 may include a baffle 660 protruding interiorly from the walls 612 toward the fluid reservoir opening 620 and toward the shaft tip 290 of the fluid reservoir plug 200.

A wall thickness of the lip 622 is less than a wall thickness of the interior wall 626, and a wall thickness of the shoulder 623 is in between the wall thickness of the lip 622 and the wall thickness of the interior wall 626. The shoulder 623 is positioned between the outer lip 622 and the inner collar 624, defining a protrusion where the outer lip 622 and the inner collar 624 abut. As shown in FIGS. 6 and 7, the interior-facing surface of the inner collar 624 angles away from the outer lip 622; thus a wall thickness of the inner collar 624 continuously increases in an interior direction (decreasing z-coordinate), moving from the shoulder 623 to the interior wall 626.

In the case of FIG. 6, the fluid reservoir plug 200 is coupled to the fluid reservoir 610 and the fluid reservoir plug is positioned in the sealed position. In FIG. 6, a longitudinal axis 298 is centered within the fluid reservoir opening 620. As previously described, the fluid reservoir plug 200 may be coupled to the fluid reservoir 610 by threading each of the one or more lugs 628 into the helical groove 284 of the threading 280. Further rotating the fluid reservoir plug 200 in a first direction threads the one or more lugs 628 increasingly into (e.g., in a direction towards the head 202) the helical groove 284, while rotating the fluid reservoir plug 200 in a second direction (e.g., in a direction away from the head 202, opposite from the first direction) unthreads the one or more lugs 628 increasingly out of (e.g., away from the head 202) the helical groove 284. The fluid reservoir plug 200 being fully placed at the fluid reservoir opening 620 includes the threading 280 being threaded into the fluid reservoir opening 620 until each of the plurality of seals 266 is engaged with fluid reservoir opening 620 at the interior walls 626. A shape of the one or more lugs 628 may be configured to fit slidably within the space defined by the helical groove 284, the helical ridge 282, and the interior wall 626. In one example, a cross-sectional shape of the one or more lugs 628 is trapezoidal.

Engaging each of the plurality of seals 266 includes each of the plurality of seals 266 being compressed between one of the plurality of grooves 264 and the interior walls 626, thereby sealing the fluid reservoir opening 620. In other words, fluid reservoir opening 620 being sealed includes the engaged plurality of seals 266 being positioned in the fluid path of the fluid exiting the fluid reservoir 610. As such, when at least one of the plurality of seals 266 is engaged, fluid does not flow into or out of the fluid reservoir 610. Positioning fluid reservoir plug 200 in a sealed position at the fluid reservoir opening 620 may further include the collar 226 of the fluid reservoir plug 200 being placed at (and making direct contact with) an interior surface of the fluid reservoir opening, including being placed at the shoulder 623, where the lip 622 joins with the inner collar 624. For example, the lip 261 may make direct contact with the shoulder 623 when the fluid reservoir plug 200 is positioned in the sealed position. Positioning fluid reservoir plug 200 in a sealed position at the fluid reservoir opening 620 may further include positioning the lip 622 within the spaces 214 under the tabbed protrusions 210 the lip 622 being placed against (e.g., making direct contact with) the ridge 228. Positioning fluid reservoir plug 200 in a sealed position at the fluid reservoir opening 620 may further include collar 262 being placed against an interior wall of inner collar 624. Positioning fluid reservoir plug 200 in a sealed position at the fluid reservoir opening 620 may further include the lug 628 of the fluid reservoir opening 620 making face-sharing contact with a terminus 286 of the threading 280. Said another way, the fluid reservoir opening 620 is configured to receive the fluid reservoir plug 200 by being able to position the fluid reservoir plug 200 in the sealed position (e.g., a fully placed position). In this way, the fluid reservoir plug 200 is shaped and sized to fit and be coupled to existing fluid reservoirs, such as existing oil pans 119 of vehicle systems 5, without any modifications to the existing fluid reservoirs.

In the case of FIG. 7, the fluid reservoir plug 200 being coupled to the fluid reservoir 610 includes the fluid reservoir plug 200 being partially placed at the fluid reservoir opening 620. The fluid reservoir plug 200 being in an unsealed position at the fluid reservoir opening 620 includes the threading 280 being unthreaded until each of the plurality of seals 266 is disengaged from the fluid reservoir opening 620. Disengaging each of the plurality of seals 266 includes each of the plurality of seals 266 being decoupled from the interior walls 626 of the fluid reservoir opening 620, thereby unsealing the fluid reservoir opening 620. As such, when all of the plurality of seals 266 are disengaged from the fluid reservoir 610, fluid may flow out of the fluid reservoir 610. The fluid reservoir plug 200 being in an unsealed position at the fluid reservoir opening 620 may further include the collar 226 of the fluid reservoir plug 200 being unplaced at (and being decoupled from) an interior surface of the fluid reservoir opening 620, including being unplaced from the shoulder 623, where the lip 622 joins with the inner collar 624. The fluid reservoir plug 200 being in an unsealed position at the fluid reservoir opening 620 may further include positioning the lip 622 outside of the spaces 214 under the tabbed protrusions 210 and unplacing the lip 622 from the ridge 228. The fluid reservoir plug 200 being in an unsealed position at the fluid reservoir opening 620 may further include the lug 628 of the fluid reservoir opening 620 being decoupled from a terminus 286 of the threading 280.

While the fluid reservoir plug 200 is coupled to the fluid reservoir 610 and the opening is unsealed (e.g., when the fluid reservoir plug 200 is unplaced), fluid may exit the fluid reservoir 610 by one of two types of flow paths. Fluid may exit the fluid reservoir 610 by flowing through the one or more channels 276 extending transversely through the threading 280 (dashed arrows 692), before flowing out of the conduits 274 and then past the plurality of grooves 264 placing the seals 266 (dashed arrows 696). Alternately, fluid may exit the fluid reservoir 610 by flowing through the cavity 272 (dashed arrows 694), before flowing through and out of the conduits 274, and then past the plurality of grooves 264 placing the seals 266 (dashed arrows 296). As such, fluid paths 692 and 694 merge at the intersection of the channels 276 and the conduits 274. In either of fluid paths 692 and 694, because the conduits 274 extend completely through a wall thickness of to an outer diameter the threaded shaft 270 and an outer diameter of the unthreaded shaft 260, the exiting may flow from the conduits 274 around and over the lip 265, and then past the plurality of grooves 264 and seals 266. After flowing past the unthreaded shaft 260, the fluid from fluid paths 692 and 694 is deflected at the lip 261 and redirected downwards with gravity.

The inner diameter of the interior walls 626 may be slightly larger than an outer diameter of the helical ridge 282 of the threading 280, and slightly larger than an outer diameter of the unthreaded shaft 260 at the ungrooved portions (e.g., between the grooves 264 and at collar 262). In one example, when the fluid reservoir plug 200 is threaded into the fluid reservoir opening 620, a clearance between the interior walls 626 and the fluid reservoir plug 200 may provide a slip-fit tolerance to allow for sliding and rotational motion of the fluid reservoir plug 200 relative to the fluid reservoir opening 620. As such, while the fluid reservoir plug 200 is coupled to the fluid reservoir 610 and the fluid reservoir opening 620 is unsealed, some fluid from the fluid reservoir 610 may leak between the helical ridge 282 and the interior walls 626. However, this leakage flow rate is very low, practically too small for draining the fluid reservoir 610, and much lower than the flow rate achieved by way of fluid paths and 692, 694, 696. Thus, while the fluid reservoir plug 200 is coupled to the fluid reservoir 610 and the fluid reservoir opening 620 is unsealed, the principal pathways available for fluid exiting the fluid reservoir 610 are indicated by the fluid paths indicated by dashed arrows 692, 694, and 696. In other words, while the fluid reservoir plug 200 is coupled to the fluid reservoir 610 and the fluid reservoir opening 620 is unsealed, the fluid exiting the fluid reservoir 610 flows essentially through the cavity 272 and the conduits 274 of the fluid reservoir plug 200, and through the channels 276 and the conduits 274, prior to exiting the fluid reservoir. In this way, while the fluid reservoir plug 200 is coupled to the fluid reservoir 610 and the seals 266 are disengaged, the fluid reservoir plug 200 controls the otherwise free flow of fluid from the fluid reservoir 610 and redirects the fluid flow exiting the fluid reservoir 610 downward.

Turning now to FIGS. 5A and 5B, they illustrate schematics 400 and 402 comparing two conditions of fluid draining from a fluid reservoir opening 620 of a fluid reservoir 610. Schematic 400 illustrates fluid draining freely from a fluid reservoir opening 620 without a fluid reservoir plug 200; schematic 402 illustrates fluid draining from the fluid reservoir opening 620 while the fluid reservoir plug 200 is coupled thereat. In one example, fluid reservoir 610 may correspond to the oil pan 119, fluid reservoir opening 620 may correspond to oil pan opening 129, and fluid reservoir plug 200 may correspond to plug 127 of a vehicle system 5. As depicted in FIGS. 5A and 5B, the fluid reservoir opening 620 may be positioned near a bottom of the fluid reservoir 610 so that all of the fluid in the fluid reservoir 610 may be substantially drained therefrom by hydrostatic pressure and gravity.

For the case where fluid drains freely from the fluid reservoir opening 620, a fluid stream exits the fluid reservoir 610 at the fluid reservoir opening 620 in a horizontal direction (parallel to z-coordinate axis). The distance that the fluid stream travels horizontally (relative to z-coordinate position 422 at the fluid reservoir opening 620) may be a function of a fluid hydrostatic pressure head (as indicated by the corresponding y-coordinate). FIG. 5A illustrates three example scenarios: fluid stream 414 travels a first horizontal distance 416 corresponding to when the fluid is draining from a full fluid reservoir; fluid stream 424 travels a second horizontal distance 426 corresponding to when the fluid level in the fluid reservoir 610 is at a second intermediate fluid level 420 less than full; and fluid stream 434 travels a third horizontal distance 436 corresponding to when the fluid level in the fluid reservoir 610 is at a third intermediate fluid level 430. As shown in FIG. 5A, the first horizontal distance 416 is greater than the second horizontal distance 426, and the second horizontal distance 426 is greater than the third horizontal distance 436. Thus, as the fluid hydrostatic pressure head increases, a horizontal distance that the fluid stream travels prior to being deflected downward by gravity, increases. The horizontal distance travelled by the fluid stream exiting the fluid reservoir 610 may further increase as a cross-sectional area of the fluid reservoir opening 620, increases. When the fluid level is below a threshold fluid level 440, fluid stream 444 flows freely downward from the fluid reservoir opening 620 because of the low hydrostatic pressure head. In one example, the threshold fluid level 440 may correspond to a non-zero positive fluid level (relative to the y-coordinate measured from a bottom of the fluid reservoir 610) at the fluid reservoir opening 620.

In order to drain fluid from a fluid reservoir 610, conventional fluid reservoir plugs are decoupled and removed from a fluid reservoir 610. Oil pans typically have large diameter bores, to facilitate rapid draining of the high viscosity engine oil. Thus, for the case of draining oil from an oil pan 119, when the conventional oil pan plug is removed, the draining oil exits with high velocity and travels a long horizontal distance, due to the pressure head of the oil in the engine crankcase 121 and the large bore opening of the oil pan 119. During oil changes, the exiting stream of oil is difficult to contain, and can splash and ricochet off the undersurface of various components of the vehicle system 5 that are in the vicinity of the oil pan 119. The exiting stream of oil can thus soil the undersurface components of the vehicle system as well as the maintenance operator performing the oil change. In the case where the undersurface components are not wiped clean of oil, residual oil splash can be interpreted mistakenly as engine oil leaks, which can increase vehicle system downtime and maintenance resources.

Turning now to FIG. 5B, fluid drains from the fluid reservoir opening 620 while the fluid reservoir plug 200 is coupled to the fluid reservoir 610. While coupled to the fluid reservoir 610, the fluid reservoir plug 200 may be unthreaded until the fluid reservoir opening 620 is unsealed, as described with reference to FIG. 7. While unthreading the fluid reservoir plug, the hydrostatic pressure exerted by the fluid level in the fluid reservoir 610 may act on the fluid reservoir plug in an outward direction (positive z-coordinate) relative to the fluid reservoir opening 620. As such, when the fluid reservoir opening 620 is unsealed while the fluid reservoir plug 200 is coupled to the fluid reservoir 610, the fluid flows past and through the fluid reservoir plug 200 before exiting the fluid reservoir 610. In this way, the fluid flow exiting the fluid reservoir 610 is controlled by the fluid reservoir plug 200 couple at the fluid reservoir opening 620, and fluid velocity is reduced (relative to fluid flowing freely from the fluid reservoir opening 620) as the fluid follows fluid paths 692, 694, and 696. Thus, during conditions when the fluid level is full, at a second intermediate fluid level 420, or a third intermediate fluid level 430, draining the fluid reservoir while the fluid reservoir plug 200 is coupled at the fluid reservoir opening 620 when the fluid reservoir opening is unsealed, controls the flow rate and direction of the draining fluid, thereby mitigating oil spills and splashes.

After flowing through cavity 272, channels 276, and conduits 274, fluid exiting the fluid reservoir 610 flows over the grooves 264 and disengaged seals 266 before being deflected downwards by the lip 261 in a direction tangential and parallel to the surface of the lip 261, as indicated by flow path 452. In this case, flow path 452 corresponds to fluid flow path 698 of FIG. 7. Accordingly, the fluid stream exiting the fluid reservoir does not flow in a horizontal direction (negative z-coordinate) past the head 202. As such, draining the fluid while the fluid reservoir plug 200 is coupled to the fluid reservoir 610 reduces a fluid velocity, fluid splashing, while maintaining fast draining of the fluid.

Turning now to FIG. 8, it illustrates a partial view of a fluid reservoir 610, including the fluid reservoir opening 620, directed into the fluid reservoir opening 620. In the non-limiting example of FIG. 8, the fluid reservoir 610 includes two lugs 628, however in other examples, the fluid reservoir 610 includes one or more lugs 628. Two lugs 628 symmetrically arranged about the fluid reservoir opening 620 may be advantageous as compared to a single lug 628 because threading two lugs 628 into the threading 280 simultaneously may aid in aligning and centering the fluid reservoir plug 200 in the fluid reservoir opening 620. Furthermore, two lugs 628 may be advantageous as compared to more than two lugs 628 because the lugs 628 may begin to crowd the fluid reservoir opening 620 and obstruct threading of the lugs 628 into the threading 280.

As described herein, the lugs 628 may be shaped and dimensioned to receive the fluid reservoir plug 200 at the fluid reservoir opening 620. In particular, as the fluid reservoir plug 200 rotated into (or out of) the fluid reservoir opening 620, the lugs 628 thread into (or unthread out of) the helical grooves 284, sliding in the space bound between the helical ridge 282, the helical groove 284, and the interior walls 626. Furthermore, a size and shape of the fluid reservoir opening 620 may be defined by a series of abutting straight and tapered walls, including the lip 622, shoulder 623, inner collar 624, and interior wall 626. As illustrated in cross-section in FIGS. 6 and 7, and from a perspective view directed into the fluid reservoir opening 620 in FIG. 8, a diameter of the interior wall 626 is less than a diameter of the lip 622. The shoulder 623 abuts a bottom edge of sidewalls 621 of the lip 622, and the shoulder 623 extends perpendicularly (in the negative r-coordinate) from the sidewalls 621 (extending in the positive z-coordinate). The inner collar 624 is positioned between the shoulder 623 and the interior wall 626, whereby the inner collar 624 is a tapered cylindrical wall that decreases in diameter linearly from an inner diameter of the inner collar 624 to the inner diameter of the interior wall 626.

FIG. 8 also depicts recessed portions 820 of the lip 622 for receiving tabbed protrusions 210 when the fluid reservoir plug 200 is coupled to the fluid reservoir 610. In one example, positioning the fluid reservoir plug 200 in the sealed position may include positioning ach of the tabbed protrusions 210 in a recessed portion 820. In particular, the fluid reservoir plug 200 is coupled to the fluid reservoir 610 by rotating the fluid reservoir plug 200 to thread the lugs 628 into the threading 280. When the fluid reservoir plug 200 is threaded into the fluid reservoir opening 620 so that the seals 266 are engaged (thereby sealing the fluid reservoir opening 620), the lip 622 rotatably slides into the spaces 214 under the tabbed protrusions 210 until the tabbed protrusions 210 slide past shallow shoulders 822 and are obstructed by the lip detents 824. An arc length between each corresponding pair of shallow shoulder 822 and lip detent 824 may correspond to an arc width 212 of the tabbed protrusion 210. In this way, the tabbed protrusions 210 may be positioned at the recessed portions 820 when the fluid reservoir plug 200 is coupled to the fluid reservoir 610 and the seals 266 are engaged. Said another way, positioning fluid reservoir plug 200 in a sealed position may further include placing the tabbed protrusions 210 at the recessed portions 820.

Turning now to FIG. 9, it illustrates a partial cross-sectional view of a fluid reservoir 610, including the fluid reservoir opening 620, directed out of the fluid reservoir opening 620. The cross-section CS9 (FIG. 7) is taken at the r-θ plane (or x-y plane) passing through the lugs 628 at the interior of the fluid reservoir opening 620. FIG. 9 further includes the fluid reservoir plug 200 coupled to the fluid reservoir 610. In particular, the fluid reservoir plug 200 is threaded into the fluid reservoir opening 620 until the detents 278 are positioned against the lugs 628. The lugs 628 are blocked by the detents 278 from unthreading further out of the helical grooves 284 toward the shaft tip 290. In this way, the detents 278 maintain a coupling between the fluid reservoir plug 200 and the fluid reservoir opening 620 while the seals 266 are disengaged so that fluid may drain at a controlled flow rate from the fluid reservoir 610.

In the example of FIG. 9, the fluid reservoir plug 200 includes two detents 278 positioned at diametrically opposite locations on the threading 280, and the fluid reservoir 610 includes two lugs 628 positioned at diametrically opposite locations at the fluid reservoir opening 620. The fluid reservoir plug 200 may be configured to include an equivalent number of detents 278 as the number of lugs 628 at the fluid reservoir opening 628.

Turning now to FIG. 10, it illustrates a partial cross-sectional view of the fluid reservoir 610, including the fluid reservoir opening 620, taken at CS10 of FIG. 8. In the cross-sectional view of FIG. 10, one of the lugs 628 is visible. As described previously, the lug 628 is a non-limiting example of a threadable attachment point included in the fluid reservoir 610 and positioned at the fluid reservoir opening 620. In other examples, each of the one or more threadable attachment points may include other types of threadable structures. In the example of FIG. 10, the cross-section of the lug 628 is of a trapezoidal shape, configured to slide along the helical space bound by helical groove 284, helical ridge 282, and interior wall 626, when the fluid reservoir plug 200 is coupled to the fluid reservoir 610. Furthermore, a shape of the detents 278 may be configured to receive the threadable attachment point. In the example of fluid reservoir 610, the detents 278 that are configured to receive the trapezoidal shaped lug 628. Specifically, the detents 278 each include a notch shaped like an open trapezoid that is cut into the upper flank 281 of helical groove 284.

The fluid reservoir plug 200 may easily be configured to replace conventional fluid reservoir plugs for sealing and draining existing fluid reservoirs. In particular by sizing (e.g., selecting an appropriate outer diameter and axial length of) each of the head 202, unthreaded shaft 260, the threaded shaft 270, and the shaft tip 290, the fluid reservoir plug 200 may be retrofitted to fit into the opening of existing fluid reservoirs.

Turning now to FIGS. 11-13, they illustrate side views of the fluid reservoir plug 200 in a first position, second position, and third position, relative to the detent 278 while coupled to the fluid reservoir 610. FIGS. 11-13 further show seals 266 placed at each of the plurality of grooves 264 of the fluid reservoir plug 200. FIG. 11 depicts the fluid reservoir plug 200 in the first position, when it is unthreaded from the fluid reservoir opening 620 until the lug 628 is positioned at the detent 278. Positioning the fluid reservoir plug 200 in the first position includes rotating the fluid reservoir plug 200 in a first (unthreading) direction 1110 to unthread the threading 280 until the seals 266 are disengaged from the fluid reservoir opening 620 to unseal fluid reservoir opening 620, and until the detent 278 is positioned directly adjacent to the lug 628. Positioning the fluid reservoir plug 200 in the first position may further include the lug 628 being in face-sharing contact with the detent 278.

The fluid reservoir plug 200 may be unthreaded to the first position to drain a fluid reservoir 610, when the fluid reservoir 610 is full or substantially full of fluid. Accordingly, while unthreading the fluid reservoir plug 200, fluid hydrostatic pressure inside the fluid reservoir 610 and gravity act on the fluid reservoir plug 200 in an outwards axial direction (e.g. positive z-coordinate) 1120 relative to the fluid reservoir opening 620. As such, upon the lug 628 reaching a position 1177 at the helical groove 284 opposite the detent 278, the lug 628 slides (in the negative z-coordinate) to the detent 278. Accordingly, when the fluid reservoir plug 200 is in the first position, fluid drains from the fluid reservoir 610.

After draining most of the fluid from the fluid reservoir 610, the fluid reservoir plug 200 may be positioned in a second position, as shown in FIG. 12, including unplacing the lug 628 from the detent 278 and translating the lug 628 back into the helical groove 284. Positioning the fluid reservoir plug 200 in the second position includes, while the fluid reservoir plug 200 is in the first position, pushing the head 202 in an interior direction 1210 (axial direction in the negative z-coordinate).

When the fluid level in the fluid reservoir 610 is higher, the hydrostatic fluid pressure acting on the fluid reservoir plug 200 in an outward direction is higher, and may counteract positioning of the fluid reservoir plug 200 in the second position and push the fluid reservoir plug 200 back (in a direction 1120) to the first position. After the fluid is substantially drained from the fluid reservoir 610, the fluid hydrostatic pressure acting outwardly on the fluid reservoir plug 200 is lower. Thus, positioning the fluid reservoir plug 200 in the second position may further include draining the fluid in the fluid reservoir 610 while the fluid reservoir plug 200 is in the first position before positioning the fluid reservoir plug in the second position. In this way, the fluid reservoir plug 200 can more easily be positioned and maintained in the second position.

After positioning the fluid reservoir plug 200 in the second position, the fluid reservoir plug 200 may be decoupled from the fluid reservoir opening 620 to drain any residual fluid in the fluid reservoir 610. When the fluid reservoir plug 200 is in the second position, the lug 628 is decoupled from the detent 278, and the fluid reservoir plug 200 is able to rotate because the lug 628 can slide along helical groove 284. As shown in FIG. 13, positioning the fluid reservoir plug in the third position includes, while the fluid reservoir plug 200 is in the second position, rotating the fluid reservoir plug 200 in an unthreading direction 1110 to further unthread the threading from the lug 628. Positioning the fluid reservoir plug 200 in the third position may further include, unthreading the fluid reservoir plug 200 so that the lug 628 is positioned in the helical groove 284 in an unthreaded position relative to the detent 278. Said another way, the lug 628 is positioned along the helical groove 284 closer to the shaft tip 290 than the detent 278. Accordingly, releasing the lug 628 from the detent 278 (e.g., changing a position of the fluid reservoir plug 200 from the first position to the third position) includes both translation of the fluid reservoir plug 200 (from the first position to the second position) and rotation of the fluid reservoir plug 200 (from the second position to the third position). In other words, releasing the lug 628 from the detent 278 includes a twomode transformation, specifically, translating and rotating, of the fluid reservoir plug 200.

Decoupling the fluid reservoir plug 200 from the fluid reservoir opening 620 includes unthreading of the fluid reservoir plug 200 until the lug 628 reaches an end of the threading 280 proximal to the shaft tip 290, where the helical groove 284 abuts the tapered shaft tip 290. The end of the threading 280 further includes where the upper flank 281 or the lower flank 283 directly abut to the shaft tip 290. Because the fluid has mostly been drained while the fluid reservoir plug 200 is coupled to the fluid reservoir 610 in the first position, only a threshold fluid level 440 of residual fluid remains in the fluid reservoir, for which the hydrostatic fluid head is also low. As such, draining the fluid reservoir includes decoupling the fluid reservoir plug 200 and allowing the fluid to freely drain from the fluid reservoir 610 only when the fluid level is below the threshold fluid level 440.

In the case where the fluid reservoir 610 corresponds to an oil pan 119 with oil pan opening 129 of a vehicle system 5, and the fluid reservoir plug 200 corresponds to a plug 127, the plug 127 may be positioned in the first position of FIG. 11 to drain a full oil pan when performing an oil change. In this way, the oil is drained from the oil pan while controlling the flow through the fluid reservoir plug 200 coupled to the oil pan in the first position, whereby the oil is in a more controlled manner relative to conventional oil plugs, where oil drains freely from the bore of the oil pan (FIG. 5A). Once the oil pan is substantially drained (e.g., to below the threshold fluid level 440), the fluid reservoir plug 200 may be pushed in an axial direction (negative z-coordinate direction) and moved to the second position to release the lug 628 from the detent 278. While the fluid reservoir plug 200 is in the second position, the fluid reservoir plug 200 may be further rotated to unthread the threading 280 from the lug 628 (while in the third position) and decouple the fluid reservoir plug 200 from the fluid reservoir opening 620. After the fluid reservoir plug 200 is decoupled from the fluid reservoir opening 620, any remaining residual oil (below the threshold fluid level 440) drains freely from the oil pan bore 129.

In this manner, a single-piece plug for a fluid reservoir includes a shaft, the shaft including a threading, a conduit, and a channel. The channel extends transversely through each thread of the threading to the conduit. Furthermore, while the threading is coupled to the fluid reservoir at an opening of the fluid reservoir, fluid exits the opening by flowing along the channel before flowing through the conduit. In a first example, the single-piece plug further includes a plurality of grooves, wherein while the threading is coupled to the fluid reservoir at the opening and a seal is placed at each of the plurality of grooves, the opening is unsealed when the single-piece plug is unthreaded until each of the placed seals is disengaged from the fluid reservoir. In a second example, optionally including the first example, the single-piece plug further includes, wherein the conduit is positioned between the plurality of grooves and the threading. In a third example, optionally including one or more of the first and second examples, the single-piece plug further includes, a cavity inside the shaft, wherein the cavity is fluidly connected to the conduit, and wherein, while the threading is coupled to the fluid reservoir at the opening, fluid exits the opening by flowing through the cavity before flowing through the conduit. In a fourth example, optionally including one or more of the first through third examples, the single-piece plug further includes, wherein the conduit fluidly connects the cavity and the channel. In a fifth example, optionally including one or more of the first through fourth examples, the single-piece plug further includes a head coupled to one end of the shaft, the head including a plurality of rotational drives, each of the plurality of rotational drives centered about a longitudinal axis of the shaft. In a sixth example, optionally including one or more of the first through fifth examples, the single-piece plug further includes a shaft tip coupled to the shaft distally from the head, wherein the shaft tip is without the threading. In a seventh example, optionally including one or more of the first through sixth examples, the single-piece plug further includes, wherein the shaft, the head, and the shaft tip are formed from a single, continuous piece of material.

In this manner, a fluid reservoir system includes a fluid reservoir, including an opening with a threadable attachment point, and a single-piece plug for the fluid reservoir. The single-piece plug includes a shaft, including a threading, a conduit, and a channel, the channel extending transversely through each thread of the threading to the conduit. Furthermore, while the threading is coupled to the threadable attachment point, fluid exits the opening by flowing along the channel before flowing through the conduit. In a first example, the fluid reservoir system further includes, wherein the shaft further comprises a plurality of grooves, wherein while the threading is coupled to the fluid reservoir at the opening and a seal is placed at each of the plurality of grooves, the opening is unsealed when the single-piece plug is unthreaded to a first position, the first position including when each of the seals placed at each of the plurality of grooves is disengaged from the fluid reservoir. In a second example, optionally including the first example, the fluid reservoir system further includes, wherein the threading further includes a detent, wherein the first position further includes when the detent makes face-sharing contact with the threadable attachment point. In a third example, optionally including one or more of the first and second examples, the fluid reservoir system further includes, wherein while the detent makes face-sharing contact with the threadable attachment point, the single-piece plug is unthreadable from the threadable attachment point. In a fourth example, optionally including one or more of the first through third examples, the fluid reservoir system further includes, wherein the detent includes a notch cut out from the threading. In a fifth example, optionally including one or more of the first through fourth examples, the fluid reservoir system further includes, wherein the detent is positioned at a winding of the threading furthest from the conduit. In a sixth example, optionally including one or more of the first through fifth examples, the fluid reservoir system further includes, wherein while the threading is coupled to the fluid reservoir at the opening, the opening is sealed when the single-piece plug is threaded to a sealed position, the sealed position including when the seals placed at each of the plurality of grooves is engaged with the fluid reservoir.

Turning now to FIGS. 14 and 15, it illustrates a flow charts for example methods 1400 and 1500 of operating a fluid reservoir plug 200. Instructions for carrying out the methods included herein may be executed by a controller based on instructions stored on a memory of the controller and in conjunction with signals received from various sensors. In one non-limiting example, the controller may correspond to the controller 12 of vehicle system 5, whereby the methods included herein may be executed by a controller based on instructions stored on a memory of the controller and in conjunction with signals received from the sensors described above with reference to FIG. 1. The controller may employ engine actuators of the vehicle system 5 to adjust engine operation, according to the methods described below.

Method 1400 begins at 1410, where a single-piece fluid reservoir plug is formed. As described herein, forming a single-piece fluid reservoir plug includes the fluid reservoir plug 200 being manufactured and formed from a single, continuous, unitary piece of material, without being assembled, joined, and constructed from multiple parts. Forming the single-piece fluid reservoir plug may further include the fluid reservoir plug 200 being formed from a homogeneous (with respect to composition) single piece of material. As an example, the single-piece fluid reservoir plug 200 may be injection molded from a homogeneous polymer. As described above, the fluid reservoir plug 200 includes the head 202, unthreaded shaft 260, threaded shaft 270, and shaft tip 290. Accordingly, the head 202, unthreaded shaft 260, threaded shaft 270, and shaft tip 290 are formed from a single, continuous, unitary piece of material without being assembled, joined, and constructed from multiple parts.

Method 1400 continues at 1420, where a plurality of seals are placed at each of the plurality grooves 264 of the unthreaded shaft 260. Each of the plurality of grooves 264 are shaped and dimensioned to position a seal 266 thereat such that when the fluid reservoir plug 200 is coupled or decoupled from the fluid reservoir 610, including threading and unthreading the fluid reservoir plug 200 from the fluid reservoir opening 620, each of the grooves 264 maintain a position and placing of one of the seals 266 within the groove 264. For example, the grooves 264 may maintain a position and placing of the seals 266 during threading and unthreading of the fluid reservoir plug 200 because unplacing one of the seals 266 at one of the grooves 264 may include elastically stretching the seal 266 over one or more of the shaft tip 290, threaded shaft 270, lip 265, and an ungrooved portion 263 of the unthreaded shaft 260.

Next, at 1430, method 1400 continues where the fluid reservoir plug 200 may be positioned at the fluid reservoir 610 in a sealed position. Positioning the fluid reservoir plug 200 in the sealed position may include coupling the fluid reservoir plug 200 to the fluid reservoir 610 at the fluid reservoir opening 620 by threading the lugs 628 onto the threading 280. Furthermore, positioning the fluid reservoir plug 200 in the sealed position may include rotating the fluid reservoir plug 200 (in a first direction) a plurality of revolutions until each of the seals 266 are engaged. Positioning the fluid reservoir plug 200 in the sealed position may further include one or more of placing the collar 226 of the fluid reservoir plug 200 at (and making direct contact with) an interior surface of the fluid reservoir opening 620, including being placed at the shoulder 623, placing collar 262 against an interior wall of inner collar 624, positioning lug 628 of the fluid reservoir opening 620 to make face-sharing contact with a terminus 286 of the threading 280, and placing the tabbed protrusions 210 at the recessed portions 820.

After positioning the fluid reservoir plug 200 in the sealed position, method 1400 continues at 1440 where the fluid reservoir 610 may be filled with fluid. In the case where the fluid reservoir 610 corresponds to an oil pan 119, the oil pan 119 may be filled from a fill cap at the top of the fluid reservoir 610. Next, method 1400 continues at 1450 where the fluid reservoir operating parameters are determined. In the case where the fluid reservoir 610 corresponds to an oil pan 119 in a vehicle system 5, the operating parameters may be determined by a controller 12. The operating parameters may include a crankcase pressure from CKCP sensor 177, and an elapsed time since the fluid in the fluid reservoir 610 was last drained and a fluid degradation indication. The fluid degradation indication may include one or more measures (aggregated over time or instantaneous) of the fluid properties that are correlated to fluid degradation such as fluid viscosity, fluid composition, fluid temperature, CKCP, and the like. In one example, CKCP decreasing below a threshold CKCP may indicate oil degradation, wherein the threshold CKCP is a positive non-zero pressure measured by CKCP sensor 177.

Next, at 1460, method 1400 continues where the controller 12 determines if criteria for draining fluid from the fluid reservoir 610 is met. The criteria for draining fluid from the fluid reservoir 610 may include one or more of the time elapsed since the last fluid draining is greater than a threshold elapsed time, CKCP falling below a threshold CKCP, and if one or more of the fluid properties has changed beyond a threshold value, indicative of fluid degradation. For the case where the criteria for draining fluid from the fluid reservoir 610 is not met, method 1400 continues at 1464 where the fluid reservoir plug 200 is maintained in the sealed position. After 1464, method 1400 returns to 1450. For the case where the criteria for draining fluid from the fluid reservoir 610 is met, method 1400 continues at 1470 where the fluid reservoir 610 is drained, at method 1500.

Method 1500 substantially drains the fluid from the fluid reservoir 610 while maintaining the fluid reservoir plug 200 coupled to the fluid reservoir 610 at the fluid reservoir opening 620. As depicted in FIG. 15, each of steps 1520, 1530, 1534, 1540, and 1550 are executed while the fluid reservoir plug 200 is coupled to the fluid reservoir 610 at the fluid reservoir opening 620, as indicated by dashed box 1502. At 1520, method 1500 continues where the fluid reservoir plug 200 is positioned in the first position. Positioning the fluid reservoir plug 200 in the first position includes rotating the fluid reservoir plug 200 in an unthreading direction 1110 to unthread the threading 280 until the seals 266 are disengaged from the fluid reservoir opening 620 to unseal fluid reservoir opening 620, and until the detent 278 is positioned adjacent to the lug 628. Positioning the fluid reservoir plug 200 in the first position may further include the lug 628 being in face-sharing contact with the detent 278. While the fluid reservoir plug 200 is in the first position, fluid may exit the fluid reservoir 610 by flowing substantially through the cavity 272, channels 276, and the conduits 274, before flowing over the seals 266, grooves 244, and the collar 262, and finally being redirected downwards by lip 261.

Next, at 1530, method 1500 determines if the fluid in the fluid reservoir 610 is substantially drained. The fluid in the fluid reservoir 610 being substantially drained may correspond to when a fluid level in the fluid reservoir 610 is below a threshold fluid level 440. Determining the fluid in the fluid reservoir 610 being substantially drained may include one or more of, while the fluid reservoir plug 200 is positioned in the first position, a threshold duration elapsing and a flow rate of fluid exiting the fluid reservoir 610 being less than or equal to a threshold flow rate. In one example, the threshold duration corresponds to a non-zero positive (predicted) average duration for substantially draining the fluid reservoir 610. In one example, the threshold flow rate may correspond to a zero observable flow of fluid exiting the fluid reservoir 610 while the fluid reservoir plug is in the first position. Additionally, the fluid in the fluid reservoir 610 being substantially drained may include when the fluid hydrostatic pressure in the fluid reservoir 610 ceases to maintain the fluid reservoir plug is in the first position. As described herein with respect to FIG. 12, when the fluid reservoir 610 is not substantially drained, the fluid hydrostatic pressure acts on the fluid reservoir plug 200 in an outward direction 1120; accordingly, when the fluid reservoir plug 200 is moved with a pushing force in an inward direction 1210 towards the second position, the fluid hydrostatic pressure may push the fluid reservoir plug 200 back to the first position in an outward direction 1120. However, when the fluid is substantially drained, the fluid hydrostatic pressure is negligible and no longer acts on the fluid reservoir plug 200 in the outward direction 1120. Thus, while the fluid reservoir plug 200 is in the first position, an operator may attempt to push the fluid reservoir plug 200 to the second position, and, the fluid hydrostatic pressure pushing the fluid reservoir plug 200 back to the first position indicates that the fluid reservoir 610 is not substantially drained.

For the case where the fluid is not substantially drained, method 1500 continues to 1534 where the fluid reservoir plug 200 is maintained in the first position. After 1534, method 1500 returns to 1530. For the case where the fluid is not substantially drained, method 1500 continues to 1540 where the fluid reservoir plug 200 is moved from the first position to the second position. Moving the fluid reservoir plug 200 to the second position may include, while the fluid reservoir plug 200 is in the first position, pushing the head 202 in an interior direction 1210. Moving the fluid reservoir plug 200 from the first position to the second position may further include unplacing the lug 628 from the detent 278 and translating the lug 628 back into the helical groove 284 adjacent to the detent 278. Waiting until the fluid is substantially drained before moving the fluid reservoir plug to the second and third positions, and before decoupling the fluid reservoir plug 200 from the fluid reservoir 610 helps ensure that a flow rate and velocity of fluid exiting the fluid reservoir is lower, thereby mitigating splashing and spilling of fluid.

Next, method 1500 continues at 1550 where the fluid reservoir plug 200 is positioned in the third position. Positioning the fluid reservoir plug in the third position includes, while the fluid reservoir plug 200 is in the second position, rotating the fluid reservoir plug 200 in an unthreading direction 1110 to further unthread the threading from the lug 628. Positioning the fluid reservoir plug 200 in the third position may further include unthreading the fluid reservoir plug 200 so that the lug 628 is positioned in the helical groove 284 in a more unthreaded position relative to the detent 278. Said another way, the lug 628 is positioned along the helical groove 284 closer to the shaft tip 290 than the detent 278.

After 1550, method 1500 continues at 1560 where the fluid reservoir plug 200 is decoupled from the fluid reservoir 610. Decoupling the fluid reservoir plug 200 from the fluid reservoir 610 includes unthreading of the fluid reservoir plug 200 until the lug 628 reaches an end of the threading 280 proximal to the shaft tip 290, where the helical groove 284 ends and abuts the tapered shaft tip 290. After the fluid reservoir plug 200 is decoupled from the fluid reservoir 610, method 1500 continues at 1560 where the residual fluid is drained from the fluid reservoir 610. Because the fluid has mostly been drained while the fluid reservoir plug 200 is coupled to the fluid reservoir 610 in the first position, only a threshold fluid level 440 of residual fluid remains in the fluid reservoir. As such, draining the fluid reservoir includes decoupling the fluid reservoir plug 200 and allowing the fluid to freely drain from the fluid reservoir 610 only when the fluid level is below the threshold fluid level 440. After 1560, method 1500 returns to method 1400 after 1470.

After 1470, method 1400 continues at 1480, where it determines if the fluid reservoir 610 is to be refilled. For the case where the fluid reservoir 610 is refilled, method 1400 returns to 1430; for the case where the fluid reservoir 610 is not refilled method 1400 ends.

FIGS. 2-4 and 6-13 show example configurations with relative positioning of the various components. Unless otherwise noted, if shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical z-coordinate axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Further still, unless otherwise noted, a thickness of an element may refer to a dimension of that element in the r-coordinate dimension, a diameter of an element may refer to a dimension of that element in the r-coordinate dimension relative to the longitudinal axis, and a depth or length of an element may refer to a dimension of that element in the z-coordinate dimension. Further still, unless otherwise noted, an element described as being rotationally symmetrical refers to the element having rotational symmetry relative to the θ-coordinate about the longitudinal axis 298.

In this manner, a method for a fluid reservoir system includes coupling a threading of a single-piece plug to an attachment point at an opening of a fluid reservoir, wherein the single-piece plug includes the threading, a conduit, and a channel, the channel extending transversely through each thread of the threading to the conduit. Furthermore, while the threading is coupled to the attachment point, the method includes positioning the single-piece plug in an unsealed position, and flowing a fluid from the fluid reservoir along the channel and then through the conduit before flowing the fluid out of the opening. In a first example, the method further includes, wherein the single-piece plug further comprises a plurality of grooves, the method further including, placing a seal at each of the plurality of grooves, wherein positioning the single-piece plug in the unsealed position includes, while the threading is coupled to the attachment point, unthreading the threading from the attachment point until each of the placed seals are disengaged from the fluid reservoir. In a second example, optionally including the first example, the method further includes, wherein the single-piece plug further includes a detent cut out from the threading, and wherein positioning the single-piece plug in the unsealed position includes unthreading the threading from the attachment point until the attachment point is in face-sharing contact with the detent. In a third example, optionally including one or more of the first and second examples, the method further includes, while the threading is coupled to the attachment point, sealing the opening by threading the attachment point into threading until each of the placed seals is engaged with the fluid reservoir. In a fourth example, optionally including one or more of the first through third examples, the method further includes, wherein the single-piece plug further includes a hollow shaft with an internal cavity, the threading and the channel are positioned at an external surface of the hollow shaft, and the conduit fluidly connects the internal cavity and the channel, and while the threading is coupled to the attachment point, flowing the fluid from the fluid reservoir through the internal cavity and then through the conduit before flowing the fluid out of the opening.

In this way the methods and systems for the fluid reservoir plug described herein provide several advantages over conventional drain plugs. First, the single-piece fluid reservoir plug seals a fluid reservoir while reducing fluid seepage and leaks. In particular, the fluid reservoir plug, being of single-piece design and construction reduces a number of leakage paths. Furthermore, the plurality of grooves, each of the plurality of grooves for placing a seal, provide the fluid reservoir plug with increased sealing ability as compared to conventional drain plugs. Second, having a head including a plurality of rotational drives, the fluid reservoir plug is more resistant to wear and degradation after repeated usage throughout its lifetime. Third, fluid can exit the fluid reservoir along the channel and out the conduit while the fluid reservoir plug is coupled to the opening, thereby reducing fluid splashes and spills during fluid changes and draining. Fourth, the single-piece construction and design reduces manufacturing complexity. Fifth, the single-piece fluid reservoir plug can be coupled to existing fluid reservoirs and can replace conventional drain plugs without modification.

The methods and systems for the fluid reservoir plug described herein achieve the technical effects of reducing seepage and leaks from a fluid reservoir when the single-piece fluid reservoir plug is positioned in a sealed position, and controlling fluid flow exiting the fluid reservoir and reducing fluid spills when the single-piece fluid reservoir plug is positioned in an unsealed position.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A single-piece plug for a fluid reservoir, the single-piece plug comprising:

a head;

a shaft extending from the head including an unthreaded shaft and a threaded shaft, wherein the unthreaded shaft is positioned directly between the head and the threaded shaft;

a conduit positioned in the shaft between a last revolution of threading of the threaded shaft and the unthreaded shaft, wherein the conduit is positioned between a plurality of grooves and the threading;

a channel, the channel extending transversely through each thread of the threading of the threaded shaft to the conduit; and a cavity inside the shaft, wherein the cavity is fluidly connected to the conduit, and wherein, while the threading is coupled to the fluid reservoir at an opening of the fluid reservoir, fluid exits the opening by flowing through the cavity before flowing through the conduit, wherein while the threading is coupled to the fluid reservoir at the opening of the fluid reservoir, fluid exits the opening by flowing along the channel before flowing past the conduit.

2. The single-piece plug of claim 1, wherein while the threading is coupled to the fluid reservoir at the opening and a seal is placed at each of the plurality of grooves, the opening is unsealed when the single-piece plug is unthreaded until each of the placed seals is disengaged from the fluid reservoir.

3. The single-piece plug of claim 1, wherein the conduit fluidly connects the cavity and the channel.

4. The single-piece plug of claim 3, wherein the head includes a plurality of rotational drives, each of the plurality of rotational drives centered about a longitudinal axis of the shaft.

5. The single-piece plug of claim 4, further comprising a shaft tip coupled to the shaft distally from the head, wherein the shaft tip is without the threading.

6. The single-piece plug of claim 5, wherein the shaft, the head, and the shaft tip are formed from a single, continuous piece of material.

7. A fluid reservoir system, comprising:

a fluid reservoir, including an opening with a threadable attachment point, a single-piece plug for the fluid reservoir, the single-piece plug comprising:

a shaft, including a threaded shaft, wherein the threaded shaft includes a threading extending across a length of the threaded shaft;

a conduit;

a channel, the channel extending along an entire length of the threaded shaft and extending transversely through each thread of the threading to the conduit; and a detent, wherein while the detent makes face-sharing contact with the threadable attachment point, the single-piece plug is unthreadable from the threadable attachment point, and wherein the detent includes a notch cut out from the threading, wherein while the threading is coupled to the threadable attachment point, fluid exits the opening by flowing along the channel before flowing past the conduit.

8. The fluid reservoir system of claim 7, wherein the shaft further comprises a plurality of grooves, wherein while the threading is coupled to the fluid reservoir at the opening and a seal is placed at each of the plurality of grooves, the opening is unsealed when the single-piece plug is unthreaded to a first position, the first position including when each of the seals placed at each of the plurality of grooves is disengaged from the fluid reservoir.

9. The fluid reservoir system of claim 8, wherein the first position further includes when the detent makes face-sharing contact with the threadable attachment point.

10. The fluid reservoir system of claim 8, wherein while the threading is coupled to the fluid reservoir at the opening, the opening is sealed when the single-piece plug is threaded to a sealed position, the sealed position including when the seals placed at each of the plurality of grooves is engaged with the fluid reservoir.

11. The fluid reservoir system of claim 7, wherein the detent is positioned at a winding of the threading furthest from the conduit.

12. A method for a fluid reservoir system, comprising:

coupling a threading of a single-piece plug to an attachment point at an opening of a fluid reservoir, wherein the single-piece plug includes the threading, a conduit, a plurality of grooves, a detent cut out from the threading, and a channel, the channel extending transversely through each thread of the threading to the conduit, placing a seal at each of the plurality of grooves, while the threading is coupled to the attachment point, positioning the single-piece plug in an unsealed position, wherein positioning the single-piece plug in the unsealed position includes, while the threading is coupled to the attachment point, unthreading the threading from the attachment point until each of the placed seals are disengaged from the fluid reservoir and unthreading the threading from the attachment point until the attachment point is in face-sharing contact with the detent, and flowing a fluid from the fluid reservoir along the channel and then past the conduit before flowing the fluid out of the opening.

13. The method of claim 12, further comprising, while the threading is coupled to the attachment point, sealing the opening by threading the attachment point into threading until each of the placed seals is engaged with the fluid reservoir.

14. The method of claim 12, wherein the single-piece plug further includes a hollow shaft with an internal cavity, the threading and the channel are positioned at an external surface of the hollow shaft and the conduit fluidly connects the internal cavity and the channel, and while the threading is coupled to the attachment point, flowing the fluid from the fluid reservoir through the internal cavity and then through the conduit before flowing the fluid out of the opening.

* * * * *